US011377130B2

(12) United States Patent
Mesher

(10) Patent No.: US 11,377,130 B2
(45) Date of Patent: Jul. 5, 2022

(54) AUTONOMOUS TRACK ASSESSMENT SYSTEM

(71) Applicant: TETRA TECH, INC., Pasadena, CA (US)

(72) Inventor: Darel Mesher, Spruce Grove (CA)

(73) Assignee: Tetra Tech, Inc., Pasadena, CA (US)

( * ) Notice: Subject to any disclaimer, the term of this patent is extended or adjusted under 35 U.S.C. 154(b) by 22 days.

(21) Appl. No.: 16/877,106

(22) Filed: May 18, 2020

(65) Prior Publication Data

US 2020/0346673 A1 Nov. 5, 2020

Related U.S. Application Data

(63) Continuation-in-part of application No. 16/255,928, filed on Jan. 24, 2019, now Pat. No. 10,807,623, which is a continuation-in-part of application No. 16/127,956, filed on Sep. 11, 2018, now Pat. No. 10,625,760.

(60) Provisional application No. 63/016,661, filed on Apr. 28, 2020, provisional application No. 62/988,630, filed on Mar. 12, 2020, provisional application No. 62/848,630, filed on May 16, 2019, provisional application No. 62/679,467, filed on Jun. 1, 2018.

(51) Int. Cl.
*B61L 23/04* (2006.01)
*B61L 25/06* (2006.01)

(52) U.S. Cl.
CPC ..... *B61L 25/06* (2013.01); *B61L 23/045* (2013.01)

(58) Field of Classification Search
CPC ..... B61L 25/06; B61L 23/045
See application file for complete search history.

(56) References Cited

U.S. PATENT DOCUMENTS 3,562,419 A 2/1971 Stewart et al.
3,942,000 A 3/1976 Dieringer
(Continued)

FOREIGN PATENT DOCUMENTS

CA 2061014 A1 8/1992
CA 2069971 3/1993
(Continued)

OTHER PUBLICATIONS

US 8,548,242 B1, 10/2013, Longacre, Jr. (withdrawn)
(Continued)

*Primary Examiner* — Manuel L Barbee
(74) *Attorney, Agent, or Firm* — Robinson IP Law, PLLC

(57) ABSTRACT

An autonomous railway track assessment apparatus includes: a railway track assessment platform including a boxcar including an enclosed space formed therein; one or more power sources located on the boxcar; a controller; a first sensor assembly in electronic communication with the controller oriented to capture data from the railway track; an air handling system located on the rail car, the air handling system including an air blower and a heater/chiller; a set of air ducts in fluid communication with the air handling system and the first sensor assembly for supplying heated or cooled blown air from the air from the handling system to the first sensor assembly. Data from the railway track is autonomously collected by the first sensor assembly controlled by the controller and such data is stored on the data storage device.

18 Claims, 21 Drawing Sheets

(56) References Cited

U.S. PATENT DOCUMENTS 4,040,738 A 8/1977 Wagner
4,198,164 A 4/1980 Cantor
4,265,545 A 5/1981 Slaker
4,330,775 A 5/1982 Iwamoto et al.
4,490,038 A 12/1984 Theurer et al.
4,531,837 A 7/1985 Panetti
4,554,624 A 11/1985 Wickham et al.
4,600,012 A 7/1986 Kohayakawa et al.
4,653,316 A 3/1987 Fukuhara
4,676,642 A 6/1987 French
4,691,565 A 9/1987 Theurer
4,700,223 A 10/1987 Shoutaro et al.
4,731,853 A 3/1988 Hata
4,775,238 A 10/1988 Weber
4,781,060 A 11/1988 Berndt
4,899,296 A 2/1990 Khattak
4,900,153 A 2/1990 Weber et al.
4,915,504 A 4/1990 Thurston
4,974,168 A 11/1990 Marx
5,199,176 A 4/1993 Theurer et al.
5,203,089 A 4/1993 Trefouel et al.
5,221,044 A 6/1993 Guins
5,245,855 A 9/1993 Burgel et al.
5,247,338 A 9/1993 Danneskiold-Samsoe et al.
5,275,051 A 1/1994 De Beer
5,353,512 A 10/1994 Theurer et al.
5,433,111 A 7/1995 Hershey et al.
5,487,341 A 1/1996 Newman
5,493,499 A 2/1996 Theurer et al.
5,612,538 A 3/1997 Hackel et al.
5,623,244 A 4/1997 Cooper
5,627,508 A 5/1997 Cooper et al.
5,671,679 A 9/1997 Straub et al.
5,721,685 A 2/1998 Holland et al.
5,743,495 A 4/1998 Welles
5,744,815 A 4/1998 Gurevich et al.
5,757,472 A 5/1998 Wangler et al.
5,786,750 A 7/1998 Cooper
5,787,815 A 8/1998 Andersson et al.
5,791,063 A 8/1998 Kesler et al.
5,793,491 A 8/1998 Wangler et al.
5,793,492 A 8/1998 Vanaki
5,804,731 A 9/1998 Jaeggi
5,808,906 A 9/1998 Sanchez-Revuelta et al.
5,912,451 A 6/1999 Gurevich et al.
5,969,323 A 10/1999 Gurevich
5,970,438 A 10/1999 Clark et al.
5,986,547 A 11/1999 Korver et al.
6,025,920 A 2/2000 Dec
6,055,322 A 4/2000 Salganicoff
6,055,862 A 5/2000 Martens
6,062,476 A 5/2000 Stern et al.
6,064,428 A 5/2000 Trosino et al.
6,069,967 A 5/2000 Rozmus et al.
6,128,558 A 10/2000 Kernwein
6,243,657 B1 6/2001 Tuck et al.
6,252,977 B1 6/2001 Salganicoff
6,324,912 B1 12/2001 Wooh
6,347,265 B1 2/2002 Bidaud
6,356,299 B1 3/2002 Trosino et al.
6,357,297 B1 3/2002 Makino et al.
6,405,141 B1 6/2002 Carr et al.
6,416,020 B1 7/2002 Gronskov
6,496,254 B2 12/2002 Bostrom
6,523,411 B1 2/2003 Mian et al.
6,540,180 B2 4/2003 Anderson
6,570,497 B2 5/2003 Puckette, IV
6,600,999 B2 7/2003 Clark et al.
6,615,648 B1 9/2003 Ferguson et al.
6,647,891 B2 11/2003 Holmes et al.
6,665,066 B2 12/2003 Nair et al.
6,681,160 B2 1/2004 Bidaud
6,698,279 B1 3/2004 Stevenson
6,715,354 B2 4/2004 Wooh
6,768,551 B2 7/2004 Mian et al.
6,768,959 B2 7/2004 Ignagni
6,804,621 B1 10/2004 Pedanckar
6,854,333 B2 2/2005 Wooh
6,862,936 B2 3/2005 Kenderian et al.
6,873,998 B1 3/2005 Dorum
6,909,514 B2 6/2005 Nayebi
7,023,539 B2 4/2006 Kowalski
7,034,272 B1 4/2006 Leonard
7,036,232 B2 5/2006 Casagrande
7,054,762 B2 5/2006 Pagano et al.
7,084,989 B2 8/2006 Johannesson et al.
7,130,753 B2 10/2006 Pedanekar
7,152,347 B2 12/2006 Herzog et al.
7,164,476 B2 1/2007 Shima et al.
7,208,733 B2 4/2007 Mian et al.
7,213,789 B1 5/2007 Matzan
7,298,548 B2 11/2007 Mian
7,328,871 B2 2/2008 Mace et al.
7,355,508 B2 4/2008 Mian et al.
7,357,326 B2 4/2008 Hattersley et al.
7,392,117 B1 6/2008 Bilodeau et al.
7,392,595 B2 7/2008 Heimann
7,403,296 B2 7/2008 Farritor et al.
7,412,899 B2 8/2008 Mian et al.
7,463,348 B2 12/2008 Chung
7,499,186 B2 3/2009 Waisanen
7,502,670 B2 3/2009 Harrison
7,516,662 B2 4/2009 Nieisen et al.
7,555,954 B2 7/2009 Pagano et al.
7,564,569 B2 7/2009 Mian et al.
7,602,937 B2 10/2009 Mian et al.
7,616,329 B2 11/2009 Villar et al.
7,659,972 B2 2/2010 Magnus et al.
7,680,631 B2 3/2010 Selig et al.
7,681,468 B2 3/2010 Verl et al.
7,698,028 B1 4/2010 Bilodeau et al.
7,755,660 B2 7/2010 Nejikovsky et al.
7,755,774 B2 7/2010 Farritor et al.
7,769,538 B2 8/2010 Rousseau
7,832,281 B2 11/2010 Mian et al.
7,869,909 B2 1/2011 Harrison
7,882,742 B1 2/2011 Martens
7,899,207 B2 3/2011 Mian et al.
7,920,984 B2 4/2011 Farritor
7,937,246 B2 5/2011 Farritor et al.
7,942,058 B2 5/2011 Turner
8,006,559 B2 8/2011 Mian et al.
8,079,274 B2 12/2011 Mian et al.
8,081,320 B2 12/2011 Villar et al.
8,111,387 B2 2/2012 Douglas et al.
8,140,250 B2 3/2012 Mian et al.
8,150,105 B2 4/2012 Mian et al.
8,155,809 B1 4/2012 Bilodeau et al.
8,180,590 B2 5/2012 Szwilski et al.
8,188,430 B2 5/2012 Mian et al.
8,190,377 B2 5/2012 Fu
8,209,145 B2 6/2012 Paglinco et al.
8,263,953 B2 9/2012 Fomenkar et al.
8,289,526 B2 10/2012 Kilian et al.
8,326,582 B2 12/2012 Mian et al.
8,335,606 B2 12/2012 Mian et al.
8,345,948 B2 1/2013 Zarembski et al.
8,345,099 B2 2/2013 Bloom et al.
8,365,604 B2 2/2013 Kahn
8,405,837 B2 3/2013 Nagle, II et al.
8,412,393 B2 4/2013 Anderson
8,418,563 B2 4/2013 Wigh et al.
8,423,240 B2 4/2013 Mian et al.
8,424,387 B2 4/2013 Wigh et al.
8,478,480 B2 7/2013 Mian et al.
8,485,035 B2 7/2013 Wigh et al.
8,490,887 B2 7/2013 Jones
8,514,387 B2 8/2013 Scherf et al.
8,577,647 B2 11/2013 Farritor et al.
8,615,110 B2 12/2013 Landes
8,625,878 B2 1/2014 Haas et al.
8,649,932 B2 2/2014 Mian et al.
8,655,540 B2 2/2014 Mian et al.
8,682,077 B1 3/2014 Longacre, Jr.

(56) References Cited

U.S. PATENT DOCUMENTS 8,700,924 B2 4/2014 Mian et al.
8,711,222 B2 4/2014 Aaron et al.
8,724,904 B2 5/2014 Fujiki
8,806,948 B2 8/2014 Kahn et al.
8,818,585 B2 8/2014 Bartonek
8,820,166 B2 9/2014 Wigh et al.
8,868,291 B2 10/2014 Mian et al.
8,875,635 B2 11/2014 Turner et al.
8,887,572 B2 11/2014 Turner
8,903,574 B2 12/2014 Cooper et al.
8,925,873 B2 1/2015 Gamache et al.
8,934,007 B2 1/2015 Snead
8,942,426 B2 1/2015 Bar-am
8,958,079 B2 2/2015 Kainer et al.
9,036,025 B2 5/2015 Haas et al.
9,049,433 B1 6/2015 Prince
9,050,984 B2 6/2015 Li et al.
9,111,444 B2 8/2015 Kaganovich
9,121,747 B2 9/2015 Mian et al.
9,134,185 B2 9/2015 Mian et al.
9,175,998 B2 11/2015 Turner et al.
9,177,210 B2 11/2015 King
9,187,104 B2 11/2015 Fang et al.
9,195,907 B1 11/2015 Longacre, Jr.
9,205,849 B2 12/2015 Cooper et al.
9,205,850 B2 12/2015 Shimada
9,212,902 B2 12/2015 Enomoto et al.
9,222,904 B2 12/2015 Harrison
9,234,786 B2 1/2016 Groll et al.
9,255,913 B2 2/2016 Kumar et al.
9,297,787 B2 3/2016 Fisk
9,310,340 B2 4/2016 Mian et al.
9,336,683 B2 5/2016 Inomata et al.
9,340,219 B2 5/2016 Gamache et al.
9,346,476 B2 5/2016 Dargy et al.
9,347,864 B2 5/2016 Farritor et al.
9,389,205 B2 7/2016 Mian et al.
9,415,784 B2 8/2016 Bartonek et al.
9,423,415 B2 8/2016 Nanba et al.
9,429,545 B2 8/2016 Havira et al.
9,441,956 B2 9/2016 Kainer et al.
9,446,776 B2 9/2016 Cooper et al.
9,454,816 B2 9/2016 Mian et al.
9,469,198 B2 10/2016 Cooper et al.
9,518,947 B2 12/2016 Bartonek et al.
9,533,698 B2 1/2017 Warta
9,562,878 B2 2/2017 Graham et al.
9,571,796 B2 2/2017 Mian et al.
9,575,007 B2 2/2017 Rao et al.
9,580,091 B2 2/2017 Kraeling et al.
9,581,998 B2 2/2017 Cooper et al.
9,607,446 B2 3/2017 Cooper et al.
9,618,335 B2 4/2017 Mesher
9,619,691 B2 4/2017 Pang et al.
9,619,725 B2 4/2017 King
9,628,762 B2 4/2017 Farritor
9,664,567 B2 5/2017 Sivathanu et al.
9,669,852 B2 6/2017 Combs
9,671,358 B2 6/2017 Cooper et al.
9,689,760 B2 6/2017 Lanza di Scalea et al.
9,714,043 B2 7/2017 Mian et al.
9,744,978 B2 8/2017 Bhattacharjya et al.
9,752,993 B1 9/2017 Thompson et al.
9,771,090 B2 9/2017 Warta
9,796,400 B2 10/2017 Puttagunta et al.
9,810,533 B2 11/2017 Fosburgh et al.
9,825,662 B2 11/2017 Mian et al.
9,849,894 B2 12/2017 Mesher
9,849,895 B2 12/2017 Mesher
9,860,962 B2 1/2018 Mesher
9,873,442 B2 1/2018 Mesher
9,921,584 B2 3/2018 Rao et al.
9,922,416 B2 3/2018 Mian et al.
9,950,716 B2 4/2018 English
9,950,720 B2 4/2018 Mesher
9,981,671 B2 5/2018 Fraser et al.
9,981,675 B2 5/2018 Cooper et al.
9,983,593 B2 5/2018 Cooper et al.
9,989,498 B2 6/2018 Lanza di Scalea et al.
10,035,498 B2 7/2018 Richardson et al.
10,040,463 B2 8/2018 Singh
10,043,154 B2 8/2018 King
10,077,061 B2 9/2018 Schmidt et al.
10,081,376 B2 9/2018 Singh
10,086,857 B2 10/2018 Puttagunta et al.
10,167,003 B1 1/2019 Bilodeau
10,286,877 B2 5/2019 Lopez Galera et al.
10,322,734 B2 6/2019 Mesher
10,349,491 B2 7/2019 Mesher
10,352,831 B2 7/2019 Kondo et al.
10,362,293 B2 7/2019 Mesher
10,384,697 B2 8/2019 Mesher
10,392,035 B2 8/2019 Berggren
10,408,606 B1 9/2019 Raab
10,414,416 B2 9/2019 Hampapur
10,502,831 B2 12/2019 Eichenholz
10,518,791 B2 12/2019 Singh
10,543,861 B1 1/2020 Bartek et al.
10,582,187 B2 3/2020 Mesher
10,611,389 B2 4/2020 Khosla
10,613,550 B2 4/2020 Khosla
10,616,556 B2 4/2020 Mesher
10,616,557 B2 4/2020 Mesher
10,616,558 B2 4/2020 Mesher
10,618,537 B2 4/2020 Khosla
10,625,760 B2 4/2020 Mesher
10,730,538 B2 8/2020 Mesher
10,796,192 B2 10/2020 Fernandez
10,816,347 B2 10/2020 Wygant et al.
10,822,008 B2 11/2020 Wade
10,829,135 B2 11/2020 Anderson et al.
10,908,291 B2 2/2021 Mesher
10,989,694 B2 4/2021 Kawabata et al.
11,001,283 B2 5/2021 Dick et al.
11,169,269 B2 11/2021 Mesher
2001/0045495 A1 11/2001 Olson et al.
2002/0065610 A1 5/2002 Clark et al.
2002/0070283 A1 6/2002 Young
2002/0093487 A1 7/2002 Rosenberg
2002/0099507 A1 7/2002 Clark et al.
2002/0150278 A1 10/2002 Wustefeld
2002/0196456 A1 12/2002 Komiya et al.
2003/0059087 A1 3/2003 Waslowski et al.
2003/0062414 A1 4/2003 Tsikos et al.
2003/0072001 A1 4/2003 Mian et al.
2003/0075675 A1 4/2003 Braune et al.
2003/0140509 A1 7/2003 Casagrande
2003/0160193 A1 8/2003 Sanchez Revuelta et al.
2003/0164053 A1 9/2003 Ignagni
2004/0021858 A1 2/2004 Shima et al.
2004/0084069 A1 5/2004 Woodard
2004/0088891 A1 5/2004 Theurer
2004/0122569 A1 6/2004 Bidaud
2004/0189452 A1 9/2004 Li
2004/0247157 A1 12/2004 Lages
2004/0263624 A1 12/2004 Nejikovsky
2005/0121539 A1 6/2005 Takada et al.
2005/0244585 A1 11/2005 Schmeling
2005/0279240 A1 12/2005 Pedanekar et al.
2006/0017911 A1 1/2006 Villar
2006/0098843 A1 5/2006 Chew
2006/0171704 A1 8/2006 Bingle
2006/0231685 A1 10/2006 Mace et al.
2007/0136029 A1 6/2007 Selig et al.
2007/0150130 A1 6/2007 Welles
2007/0211145 A1 9/2007 Kilian et al.
2007/0265780 A1 11/2007 Kesler et al.
2007/0289478 A1 12/2007 Becker et al.
2008/0007724 A1 1/2008 Chung
2008/0177507 A1 7/2008 Mian et al.
2008/0212106 A1 9/2008 Hoffmann
2008/0298674 A1 12/2008 Baker
2008/0304065 A1 12/2008 Hesser
2008/0304083 A1 12/2008 Farritor et al.

(56) References Cited

U.S. PATENT DOCUMENTS

2009/0040503 A1 2/2009 Kilian
2009/0073428 A1 3/2009 Magnus
2009/0196486 A1 8/2009 Distante et al.
2009/0250533 A1 10/2009 Akiyama et al.
2009/0273788 A1 11/2009 Nagle et al.
2009/0319197 A1 12/2009 Villar et al.
2010/0007551 A1 1/2010 Pagliuco
2010/0026551 A1 2/2010 Szwilski
2010/0106309 A1 4/2010 Grohman et al.
2010/0207936 A1 8/2010 Minear
2010/0289891 A1 11/2010 Akiyama
2011/0064273 A1 3/2011 Zarembski et al.
2011/0209549 A1 9/2011 Kahn
2011/0251742 A1 10/2011 Haas et al.
2012/0026352 A1 2/2012 Natroshvilli et al.
2012/0051643 A1 3/2012 Ha et al.
2012/0062731 A1 3/2012 Enomoto et al.
2012/0192756 A1 8/2012 Miller et al.
2012/0218868 A1 8/2012 Kahn et al.
2012/0222579 A1 9/2012 Turner et al.
2012/0245908 A1 9/2012 Berggren
2012/0263342 A1 10/2012 Haas
2012/0300060 A1 11/2012 Farritor
2013/0070083 A1 3/2013 Snead
2013/0092758 A1 4/2013 Tanaka et al.
2013/0096739 A1 4/2013 Landes et al.
2013/0155061 A1 6/2013 Jahanashahi et al.
2013/0170709 A1 7/2013 Distante et al.
2013/0191070 A1 7/2013 Kainer
2013/0202090 A1 8/2013 Belcher et al.
2013/0230212 A1 9/2013 Landes
2013/0231873 A1 9/2013 Fraser
2013/0276539 A1 10/2013 Wagner et al.
2013/0313372 A1 11/2013 Gamache et al.
2013/0317676 A1 11/2013 Cooper et al.
2014/0069193 A1 3/2014 Graham et al.
2014/0129154 A1 5/2014 Cooper
2014/0142868 A1 5/2014 Bidaud
2014/0151512 A1 6/2014 Cooper
2014/0177656 A1 6/2014 Mian et al.
2014/0200952 A1 7/2014 Hampapur et al.
2014/0333771 A1 11/2014 Mian et al.
2014/0339374 A1 11/2014 Mian et al.
2015/0106038 A1 4/2015 Turner
2015/0131108 A1 5/2015 Kainer et al.
2015/0219487 A1 8/2015 Maraini
2015/0225002 A1 8/2015 Branka et al.
2015/0268172 A1 9/2015 Naithani et al.
2015/0269722 A1 9/2015 Naithani et al.
2015/0284912 A1 10/2015 Delmonic et al.
2015/0285688 A1 10/2015 Naithani et al.
2015/0375765 A1 12/2015 Mustard
2016/0002865 A1 1/2016 English et al.
2016/0039439 A1 2/2016 Fahmy et al.
2016/0059623 A1 3/2016 Kilian
2016/0082991 A1* 3/2016 Warta ..... B61L 27/0088 246/167 R
2016/0121912 A1 5/2016 Puttagunta et al.
2016/0159381 A1 6/2016 Fahmy
2016/0207551 A1 7/2016 Mesher
2016/0209003 A1 7/2016 Mesher
2016/0212826 A1 7/2016 Mesher
2016/0221592 A1 8/2016 Puttagunta
2016/0249040 A1 8/2016 Mesher
2016/0282108 A1 9/2016 Martinod Restrepo et al.
2016/0304104 A1 10/2016 Witte et al.
2016/0305915 A1 10/2016 Witte et al.
2016/0312412 A1 10/2016 Schrunk, III
2016/0318530 A1 11/2016 Johnson
2016/0321513 A1 11/2016 Mitti et al.
2016/0325767 A1 11/2016 LeFabvre et al.
2016/0368510 A1 12/2016 Simon et al.
2017/0029001 A1 2/2017 Berggren
2017/0034892 A1 2/2017 Mesher
2017/0066459 A1 3/2017 Singh
2017/0106885 A1* 4/2017 Singh ..... G01B 11/22
2017/0106887 A1 4/2017 Mian et al.
2017/0182980 A1 6/2017 Davies et al.
2017/0203775 A1 7/2017 Mesher
2017/0205379 A1 7/2017 Prince et al.
2017/0219471 A1 8/2017 Fisk et al.
2017/0267264 A1 9/2017 English et al.
2017/0297536 A1 10/2017 Giraud et al.
2017/0305442 A1 10/2017 Viviani
2017/0313286 A1 11/2017 Giraud et al.
2017/0313332 A1 11/2017 Paget et al.
2017/0336293 A1 11/2017 Kondo et al.
2018/0038957 A1 2/2018 Kawazoe et al.
2018/0039842 A1 2/2018 Schuchmann et al.
2018/0057030 A1 3/2018 Puttagunta et al.
2018/0079433 A1 3/2018 Mesher
2018/0079434 A1 3/2018 Mesher
2018/0106000 A1 4/2018 Fruehwirt
2018/0120440 A1 5/2018 O'Keefe
2018/0127006 A1 5/2018 Wade
2018/0220512 A1 8/2018 Mesher
2018/0222504 A1 8/2018 Birch et al.
2018/0276494 A1 9/2018 Fernandez
2018/0281829 A1 10/2018 Euston et al.
2018/0339720 A1 11/2018 Singh
2018/0370552 A1 12/2018 Puttagunta et al.
2018/0372875 A1 12/2018 Juelsgaard et al.
2019/0039633 A1 2/2019 Li
2019/0054937 A1 2/2019 Graetz
2019/0107607 A1 4/2019 Danziger
2019/0135315 A1 5/2019 Dargy et al.
2019/0156569 A1 5/2019 Jung et al.
2019/0179026 A1 6/2019 Englard et al.
2019/0248393 A1 8/2019 Khosla
2019/0310470 A1* 10/2019 Weindorf ..... B60R 11/04
2019/0349563 A1 11/2019 Mesher
2019/0349564 A1 11/2019 Mesher
2019/0349565 A1 11/2019 Mesher
2019/0349566 A1 11/2019 Mesher
2019/0357337 A1 11/2019 Mesher
2019/0367060 A1 12/2019 Mesher
2019/0367061 A1 12/2019 Mesher
2020/0025578 A1 1/2020 Wygant et al.
2020/0034637 A1 1/2020 Olson et al.
2020/0086903 A1 3/2020 Mesher
2020/0156677 A1 5/2020 Mesher
2020/0160733 A1 5/2020 Dick et al.
2020/0164904 A1 5/2020 Dick et al.
2020/0180667 A1 6/2020 Kim et al.
2020/0198672 A1 6/2020 Underwood et al.
2020/0221066 A1 7/2020 Mesher
2020/0231193 A1 7/2020 Chen et al.
2020/0239049 A1 7/2020 Dick et al.
2020/0302592 A1 9/2020 Ebersohn et al.
2020/0346673 A1 11/2020 Mesher
2020/0363532 A1 11/2020 Mesher
2020/0400542 A1 12/2020 Fisk et al.
2021/0019548 A1 1/2021 Fernandez
2021/0041398 A1 2/2021 Van Wyk et al.
2021/0041877 A1 2/2021 Lacaze et al.
2021/0049783 A1 2/2021 Saniei et al.
2021/0061322 A1 3/2021 Dick et al.
2021/0072393 A1 3/2021 Mesher
2021/0078622 A1 3/2021 Miller et al.
2021/0229714 A1 7/2021 Dick et al.

FOREIGN PATENT DOCUMENTS

CA 2574428 A1 2/2006
CA 2607634 A1 4/2008
CA 2574428 C 10/2009
CA 2782341 A1 6/2011
CA 2844113 2/2013
CA 2986580 9/2014
CA 2867560 A1 4/2015
CA 2607634 C 6/2015
CA 2945614 10/2015
CA 2945614 A1 10/2015
CA 2732971 1/2016

(56) References Cited

FOREIGN PATENT DOCUMENTS

| | | | |
|---|---|---|---|
| CA | 2996128 | | 3/2016 |
| CA | 2860073 | | 5/2016 |
| CA | 2867560 | C | 7/2017 |
| CA | 2955105 | | 7/2017 |
| CN | 104751602 | | 7/2015 |
| CN | 106291538 | A | 1/2017 |
| CN | 106364503 | A | 2/2017 |
| CN | 106373191 | A | 2/2017 |
| CN | 106384190 | A | 2/2017 |
| CN | 1045356526 | | 6/2017 |
| CN | 107688024 | A | 2/2018 |
| CN | 206984011 | U | 2/2018 |
| CN | 108009484 | A | 5/2018 |
| CN | 108657222 | | 10/2018 |
| CN | 113626975 | A | 11/2021 |
| DE | 19831176 | | 1/2000 |
| DE | 19831215 | | 1/2000 |
| DE | 10040139 | | 7/2002 |
| DE | 19826422 | | 9/2002 |
| DE | 60015268 | | 3/2005 |
| DE | 19943744 | | 1/2006 |
| DE | 19919604 | | 8/2009 |
| DE | 102012207427 | | 7/2013 |
| DE | 102009018036 | | 2/2014 |
| DE | 102014119056 | | 6/2016 |
| EP | 0274081 | | 7/1988 |
| EP | 1079322 | | 2/2001 |
| EP | 1146353 | | 10/2001 |
| EP | 1158460 | | 11/2001 |
| EP | 1168269 | | 1/2002 |
| EP | 1197417 | A1 | 4/2002 |
| EP | 1236634 | A1 | 9/2002 |
| EP | 1098803 | | 1/2003 |
| EP | 1600351 | | 1/2007 |
| EP | 1892503 | | 7/2007 |
| EP | 1918702 | A2 | 5/2008 |
| EP | 1964026 | | 9/2008 |
| EP | 1992167 | | 5/2016 |
| EP | 3024123 | | 5/2016 |
| EP | 2806065 | | 9/2016 |
| EP | 3138753 | A1 | 3/2017 |
| EP | 3138754 | A1 | 3/2017 |
| EP | 2697738 | | 8/2017 |
| EP | 2697738 | B1 | 8/2017 |
| EP | 2998927 | | 9/2018 |
| EP | 3431359 | | 1/2019 |
| EP | 3561501 | | 10/2019 |
| EP | 3105599 | | 4/2020 |
| EP | 3433154 | | 6/2020 |
| EP | 3689706 | | 8/2020 |
| EP | 3685117 | B1 | 11/2021 |
| FR | 2674809 | | 10/1992 |
| FR | 3049255 | A1 | 9/2017 |
| FR | 3077553 | | 2/2018 |
| FR | 304925561 | | 4/2018 |
| FR | 3052416 | | 7/2019 |
| FR | 3077553 | | 8/2019 |
| GB | 2419759 | | 6/1985 |
| GB | 2265779 | | 10/1993 |
| GB | 2378344 | | 2/2003 |
| GB | 2383635 | B | 6/2005 |
| GB | 2403861 | | 3/2006 |
| GB | 2536746 | | 9/2016 |
| GB | 2536746 | B | 3/2017 |
| JP | 51001138 | B1 | 1/1976 |
| JP | 60039555 | | 3/1985 |
| JP | 63302314 | | 12/1988 |
| JP | 6011316 | | 1/1994 |
| JP | 06322707 | | 11/1994 |
| JP | H07146131 | | 6/1995 |
| JP | 7280532 | | 10/1995 |
| JP | H07294443 | | 11/1995 |
| JP | H07294444 | | 11/1995 |
| JP | 10332324 | | 12/1998 |
| JP | 11172606 | | 6/1999 |
| JP | 2000221146 | | 8/2000 |
| JP | 2000241360 | | 9/2000 |
| JP | H0924828 | | 7/2002 |
| JP | 2002294610 | | 10/2002 |
| JP | 2003074004 | | 3/2003 |
| JP | 2003121556 | | 4/2003 |
| JP | 2004132881 | | 4/2004 |
| JP | 2007240342 | | 9/2007 |
| JP | 4008082 | | 11/2007 |
| JP | 2010229642 | A | 10/2010 |
| JP | 5283548 | | 9/2013 |
| JP | 5812595 | | 11/2015 |
| JP | 2015209205 | | 11/2015 |
| JP | 2016191264 | A | 11/2016 |
| JP | 6068012 | B2 | 1/2017 |
| JP | 2017020862 | A | 1/2017 |
| JP | 6192717 | B2 | 9/2017 |
| JP | 7327413 | B2 | 5/2018 |
| JP | 6425990 | B2 | 11/2018 |
| JP | 2019065650 | A | 4/2019 |
| JP | 6530979 | B2 | 6/2019 |
| KR | 101562635 | | 10/2015 |
| KR | 101706271 | B1 | 2/2017 |
| KR | 1020180061929 | A | 6/2018 |
| RU | 2142892 | | 12/1999 |
| RU | 101851 | | 1/2011 |
| SU | 1418105 | | 8/1988 |
| WO | 2000/05576 | A2 | 2/2000 |
| WO | 2000/08459 | | 2/2000 |
| WO | 2000-73118 | A1 | 12/2000 |
| WO | 2001/066401 | A1 | 9/2001 |
| WO | 31/86227 | | 11/2001 |
| WO | 2001066401 | | 5/2003 |
| WO | 2005/036199 | A2 | 4/2005 |
| WO | 2005036199 | | 4/2005 |
| WO | 2005098352 | | 10/2005 |
| WO | 2006008292 | | 1/2006 |
| WO | 2006014893 | | 2/2006 |
| WO | 2010091970 | | 8/2010 |
| WO | 2011002534 | | 1/2011 |
| WO | 2011126802 | | 10/2011 |
| WO | 2012142548 | A1 | 10/2012 |
| WO | 2013146502 | | 3/2013 |
| WO | 2013/177393 | A1 | 11/2013 |
| WO | 2014017015 | | 1/2014 |
| WO | 2015160300 | A1 | 10/2015 |
| WO | 2015/165560 | A1 | 11/2015 |
| WO | 2016/008201 | A1 | 1/2016 |
| WO | 2016/027072 | A1 | 2/2016 |
| WO | 2016007393 | A3 | 7/2016 |
| WO | 2016168576 | | 10/2016 |
| WO | 2016168623 | | 10/2016 |
| WO | 2017159701 | A1 | 9/2017 |
| WO | 2018158712 | | 9/2018 |
| WO | 2018207469 | | 11/2018 |
| WO | 2018208153 | | 11/2018 |
| WO | 2018210441 | | 11/2018 |
| WO | 2019/023613 | A1 | 1/2019 |
| WO | 2019/023658 | A1 | 1/2019 |
| WO | 2019023613 | | 1/2019 |
| WO | 2019023658 | | 1/2019 |
| WO | WO-2019023658 | A1 * | 1/2019 ..... H04N 5/232 |
| WO | 2019086158 | | 5/2019 |
| WO | 2019212693 | | 11/2019 |
| WO | 2020078703 | | 4/2020 |
| WO | 2020232431 | | 11/2020 |
| WO | 2020232443 | | 11/2020 |

OTHER PUBLICATIONS

US Patent and Trademark Office, Non-Final Office Action for U.S. Appl. No. 16/255,928 dated Oct. 18, 2019.

US Patent and Trademark Office, Final Office Action for U.S. Appl. No. 16/127,956 dated Jul. 9, 2019.

US Patent and Tademark Office, Non-Final Office Action for U.S. Appl. No. 17/076,899 dated Jan. 29, 2021.

T. Kanade, ed., Three-Dimensional Machine Vision, Kluwer Academic Publishers (1987) [Part 1].

(56) References Cited

OTHER PUBLICATIONS

T. Kanade, ed., Three-Dimensional Machine Vision, Kluwer Academic Publishers (1987) [Part 2].
D.D. Davis et al., "Tie Condition Inspection a Case Study of Tie Failure Rate, Mods, and Clustering," Report No. R-714, Association of American Railroads Research and Test Department (Jul. 1989).
John Choros et al., "Prevention of Derailments due to Concrete Tie Rail Seat Deterioration," Proceedings of ASME/IEEE Joint Rail Conference & Internal Combustion Engine Spring Technical Conference. No. 40096 (2007).
"Laser Triangulation for Track Change and Defect Detection", U.S. Department of Transportation, Federal Railroad Administration (Mar. 2020).
"Extended Field Trials of LRAIL for Automated Track Change Detection", U.S. Department of Transportation, Federal Railroad Administration (Apr. 2020).
US Patent and Trademark Office, Non-Final Office Action for U.S. Appl. No. 14/725,490 dated Feb. 23, 2018.
Shawn Landers et al., "Development and Calibration of a Pavement Surface Performance Measure and Prediction Models for the British Columbia Pavement Management System" (2002).
Zheng Wu, "Hybrid Multi-Objective Optimization Models for Managing Pavement Assetts" (Jan. 25, 2008).
"Pavement Condition Index 101", OGRA's Milestones (Dec. 2009).
"Rail Radar Bringing the Track Into the Office" presentation given to CN Rail Engineering on Jan. 21, 2011.
Rail Radar, Inc. Industrial Research Assistance Program Application (IRAP) (Aug. 10, 2012).
"Rail Radar Automated Track Assessment" paper distributed at the Association of American Railways (AAR) Transportation Test Center in Oct. 2010 by Rail Radar, Inc.
US Patent and Trademark Office, Non-Final Office Action for U.S. Appl. No. 14/725,490 dated Mar. 30, 2017.
US Patent and Trademark Office, Final Office Action for U.S. Appl. No. 14/725,490 dated Aug. 16, 2017.
Kantor, et al., "Automatic Railway Classification Using Surface and Subsurface Measurements" Proceedings of the 3rd International Conference on Field and Service Robitics, pp. 43-48 (2001).
Magnes, Daniel L., "Non-Contact Technology for Track Speed Rail Measurements (ORIAN)" SPIE vol. 2458, pp. 45-51 (1995).
Ryabichenko, et al. "CCD Photonic System For Rail Width Measurement" SPIE vol. 3901, pp. 37-44 (1999).
Gingras, Dennis, "Optics and Photonics Used in Road Transportation" (1998).
Liviu Bursanescu and Francois Blais, "Automated Pavement Distress Data Collection and Analysis: a 3-D Approach" (1997).
US Patent and Trademark Office, Non-Final Office Action for U.S. Appl. No. 14/724,925 dated Feb. 26, 2016.
US Patent and Trademark Office, Non-Final Office Action for U.S. Appl. No. 14/724,890 dated Jul. 29, 2016.
US Patent and Trademark Office, Final Office Action for U.S. Appl. No. 14/724,890 dated Nov. 10, 2016.
US Patent and Trademark Office, Non-Final Office Action for U.S. Appl. No. 14/724,890 dated Mar. 24, 2017.
Korean Intellectual Property Office, International Search Report for Int. App. No. PCT/IB2018/058574 dated Feb. 27, 2019.
Korean Intellectual Property Office, Written Opinion of the International Searching Authority for Int. App. No. PCT/IB2018/058574 dated Feb. 27, 2019.
US Patent and Trademark Office, Final Office Action for U.S. Appl. No. 16/255,928 dated Apr. 27, 2020.
US Patent and Trademark Office, Non-Final Office Action for U.S. Appl. No. 16/742,057 dated May 26, 2020.
Invitation to Pay Additional Fees, PCT App. Ser. No. PCT/US2020/033449 dated Jul. 9, 2020.
International Report on Patentability, PCT App. Ser. No. PCT/IB2018/058574 dated Aug. 6, 2020.
International Reporton Patentability, PCT App. Ser. No. PCT/US2020/033374 dated Aug. 14, 2020.
Espino et al., "Rail and Turnout Detection Using Gradient Information and Template Matching", 2013 IEEE Interntiojnal Conference on Intelligent Rail Transportation Proceedings (2013).
U.S. Patent and Tademark Office, Non-Final Office Action for U.S. Appl. No. 17/243,746 dated Aug. 27, 2021.
Paul et al., "A Technical Evaluation of Lidar-Based Measurement of River Water Levels", Water Resources Research (Apr. 4, 2020).
Ahn et al., "Estimating Water Reflectance at Near-Infrared Wavelengths for Turbid Water Atmospheric Correction: A Preliminary Study for GOCI-II", Remote Sensing (Nov. 18, 2020).
Hart et al., "Automated Railcar and Track Inspection Projects: A Review of Collaborations Between CVRL and RailTEC", presentation by Computer Vision and Robotics Laboratory and Railroad Engineering Program (RailTEC) University of Illinois at Urbana-Champaign (2017).
International Search Report and Written Opinion of the International Searching Authority, PCT App. Ser. No. PCT/US2020/033449 dated Sep. 14, 2020 (including Kovalev et al. "Freight car models and their computer-aided dynamic analysis", Multibody System Dynamics, Nov. 2009).
Julio Molleda et al., "A Profile Measurement System for Rail Manufacturing using Multiple Laser Range Finders" (2015).
US Patent and Trademark Office, Non-Final Office Action for U.S. Appl. No. 16/802,763 dated Jun. 29, 2021.
Yang et al., "Automated Extraction of 3-D Railway Tracks from Mobile Laser Scanning Point Clouds", IEEE Journal of Selected Topics in Applied Earth Observations and Remote Sensing, vol. 7, No. 12, Dec. 2014.
Li et al., "Rail Component Detection, Optimization, and Assessment for Automatic Rail Track Inspection", IEEE Transactions of Intelligent Transportation Systems, vol. 15, No. 2, Apr. 2014.
International Preliminary Report on Patentability, PCT Application No. PCT/US2020/033449, completed May 24, 2021 and dated Aug. 12, 2021.
US Patent and Trademark Office, Non-Final Office Action for U.S. Appl. No. 16/127,956 dated Dec. 31, 2018.
D.D. Davis et al., "Tie Performance—A Progress Report of the Des Plaines Test Site," Report No. R-746, Association of American Railroads Research and Test Department (Apr. 1990).
Mattias Johanneson, "Architectures for Sheet-of-Light Range Imaging," Report No. LiTH-ISY-I-1335, Image Processing Group, Department of Eleclrical Engineering, Linköping University (Feb. 27, 1992).
U.S. Appl. No. 60/584,769, "System & Method For Inspecting Railroad Track" by John Nagle & Steven C. Orrell.
Mattias Johannesson, "Sheet-of-light Range Imaging," Linköping Studies in Science and Technology. Dissertations No. 399 (1995).
M. Johannesson, SIMD Architectures for Range and Radar Imaging, PhD thesis, University of Linköping (1995).
Erik Åstrand, "Automatic Inspection of Sawn Wood," Linköping Studies in Science and Technology. Dissertations. No. 424 (1996).
Mattias Johannesson, "Sheet-of-Light range imaging experiments with MAPP2200," Report No. LiTH-ISY-I-1401, Image Processing Group, Department of Electrical Engineering, Linköping University (Sep. 28, 1992).
M. de Bakker et al., "A Smart Range Image Sensor," Proceedings of the 24th European Solid-State Circuits Conference (1998):208-11;xii+514.
Dr. Mats Gokstorp et al., "Smart Vision Sensors," International Conference on Image Processing (Oct. 4-7, 1998), Institute of Electrical and Electronics Engineers, Inc.
Mattias Johanneson, et al., "An Image Sensor for Sheet-of-Light Range Imaging," IAPR Workshop on Machine Vision Applications (Dec. 7-9, 1992).
Mattias Johannesson, "Can Sorting using sheet-of-light range imaging and MAPP2200," Institute of Electrical and Electronics Engineers; International Conference on Systems, Man and Cybernetics (Oct. 17-20, 1993).
Michiel de Bakker, et al., "Smart PSD array for sheet-of-light range imaging," The International Society for Optical Engineering. Sensors and Camera Systems for Scientific, Industrial, and Digital Photography Applications (Jan. 24-26, 2000).

(56) References Cited

OTHER PUBLICATIONS

Umayal Chidambaram, "Edge Extraction of Color and Range Images," (Dec. 2003).
Franz Pernkopf et al., "Detection of surface defects on raw milled steel blocks using range imaging" The International Society for Optical Engineering. Machine Vision Applications in Industrial Inspection X (Jan. 21-22, 2002).
Murhed, Anders, "IVP Integrated Vision Products," Pulp and Paper International 44.12 (Dec. 1, 2002).
Anders Åstrand, "Smart Image Sensors," Linköping Studies in Science and Technology Dissertations No. 319 (1993).
Mattias Johannesson et al., "Five Contributions to the Art of Sheet-of-light Range Imaging on MAPP2200," Report No. LiTH-ISY-R-1611, Image Processing Group, Department of Electrical Engineering, Linköping University (Apr. 14, 1994).
Federal Register, vol. 73 (70695-70696).
Newman et al., "A Survey of Automated Visual Inspection," Computer Vision an Image Understanding vol. 61, No. 2, March, pp. 231-262, 1995.
J. Velten et al., "Application of a Brightness-Adapted Edge Detector for Real-Time Railroad Tie Detection in Video Images," Institute of Electrical and Electronics Engineers (1999).
R. Gordon Kennedy, "Problems of Cartographic Design in Geographic Information Systems for Transportation," Cartographic Perspectives (Jul. 20, 1999).
Richard Reiff, "An Evaluation of Remediation Techniques for Concrete Tie Rail Seat Abrasion in the Fast Environment," American Railway Engineering Association, Bulletin 753 (1995).
Russell H. Lutch et al., "Causes and Preventative Methods for Rail Seat Abrasion in North America's Railroads," Conference Paper (Oct. 2014).
Nigel Peters and Steven R. Mattson, "CN 60E Concrete Tie Development," AREMA: 25 (2003).
Federal Register, vol. 76, No. 175, pp. 55819-55825.
National Transportation Safety Board, "Railroad Accident Brief" (NTSB/RAB—Jun. 2003).
Arthur L. Clouse et al. "Track Inspection Into the 21st Century" (Sep. 19, 2006).
Federal Register, vol. 76, No. 63, pp. 18001-18346 (18073).
Railroad Safety Advisory Committee (RSAC), Minutes of Meeting, Dec. 10, 2008, Washington, D.C.
Dennis P. Curtin, "An Extension to The Textbook of Digital Photography, Pixels and Images" (2007).
Holland L.P.'s Combined Motion for Early Markman Claim Construction and Summary Judgment of Non-Infringement in *Georgetown Rail Equipment Company* v. *Holland L.P.*, (E.D. Tex.) (Tyler) (6:13-cv-366).
Georgetown Rail Equipment Company's Response to Holland L.P.'s Combined Motion for Early Markman Claim Construction and Summary Judgment of Non-Infringement in *Georgetown Rail Equipment Company* v. *Holland L.P.*, (E.D. Tex.) (Tyler) (6:13-cv-366).
Georgetown Rail Equipment Company's P.R. 4-5(a) Opening Markman Claim Construction Brief in *Georgetown Rail Equipment Company* v. *Holland L.P.*, (E.D. Tex) (Tyler) (6:13-cv-366).
Holland L.P.'s Responsive Markman Claim Construction Brief Under P R. 4-5 in *Georgetown Rail Equipment Company* v. *Holland L.P.*, (E.D. Tex.) (Tyler) (6:13-cv-366).
Claim Construction Memorandum Opinion and Order in *Georgetown Rail Equipment Company* v. *Holland L.P.*, (E.D. Tex.) (Tyler) (6:13-cv-366).
Public Judgment and Reasons in *Georgetown Rail Equipment Company* v. *Rail Radar Inc. and Tetra Tech EBA Inc.* (T-896-15) (2018 FC 70).
Pavemetrics' Compulsory Counterclaim for Declaratory Judgment, *Pavemetrics Systems, Inc.* v. *Tetra Tech, Inc.* (case 2:21-cv-1289) (Mar. 24, 2021).
Handbook of Computer Vision and Applications, vol. 2, Academic Press, "Signal Processing and Pattern Recognition" (1999).
International Advances in Nondestructive Testing, vol. 16, Gordon and Breach Science Publishers, S.A. (1991).
Babenko, Pavel, dissertation entitled "Visual Inspection of Railroad Tracks", University of Central Florida (2009).
Shah, Mubarak, "Automated Visual Inspection/Detection of Railroad Track", Florida Department of Transportation (Jul. 2010).
Metari et al., "Automatic Track Inspection Using 3D Laser Profilers to Improve Rail Transit Asset Condition Assessment and State of Good Repair—A Preliminary Study", TRB 93rd Annual Meeting (Nov. 15, 2013).
Laurent, John et al., "Implementation and Validation of a New 3D Automated Pavement Cracking Measurement Equipment" (2010).
Final Written Judgment, U.S. Patentent Trial and Appeal Board, Inter Partes Review, *Tetra Tech Canada, Inc.* v. *Georgetown Rail Equipment Company*, (2020).
Tetra Tech, Inc. Annual Report excerpts (2020).
Federal Railroad AdminisliaLion Track Safety Standards Fact Sheet.
Declaration of David Drakes, *Pavemetrics Systems, Inc.* v. *Tetra Tech, Inc.* (case 2:21-cv-1289) (Mar. 22, 2021).
Declaration of John Laurent, *Pavemetrics Systems, Inc.* v. *Tetra Tech, Inc.* (case 2:21-cv-1289) (Mar. 22, 2021).
"An Automated System for Rail Transit Infrastructure Inspection", 1st Quarterly Report, USDOT and University of Massachusetts Lowell (Sep. 30, 2012).
IRI Measurements Using the LCMS presentation, Pavemetrics (2012).
High-speed 3D imaging of rail YouTube URL link and associated image.
LCMS for High-speed Rail Inspection video URL link and image.
"An Automated System for Rail Transit Infrastructure Inspection", 2d Quarterly Report, USDOT and University of Massachusetts Lowell (Jan. 15, 2013).
RITARS 3rd Quarterly Meeting Minutes, "An Automated System for Rail Transit Infrastructure Inspection" (May 14, 2013).
"An Automated System for Rail Transit Infrastructure Inspection", 5th Quarterly Report, USDOT and University of Massachusetts Lowell (Oct. 15, 2013).
25th Annual Road Profile User's Group Meeting agenda, San Antonio, Texas (Sep. 16, 2013).
"LCMS—Laser Crack Measurement System" presentation, PAVEMETRICS Systems Inc. (Sep. 2013).
Metari, et al., "An Automatic Track Inspection Using 3D Laser Profilers to Improve Rail Transit Asset Condition Assessment and State of Good Repair: A Preliminary Study" presentation, Transportation Research Board 93rd Annual Meeting (given Jan. 14, 2014).
Lorent, et al., "Detection of Range-Based Rail Gage and Missing Rail Fasteners: Use of High-Resolution Two- and Three-dimensional Images" (Jan. 2014).
"3D Mapping of Pavements: Geometry and DTM" presentation, PAVEMETRICS Systems Inc. (Sep. 2014).
"Laser Rail Inspection System (LRAIL)" datasheet, PAVEMETRICS Systems Inc. (Oct. 2014).
PAVEMETRICS Systems Inc. webpage screenshot (Dec. 18, 2014).
PAVEMETRICS Systems Inc. LRAIL webpage (Feb. 20, 2015).
Pavemetrics' Memorandum in Opposition to motion for Preliminary Injunction, *Pavemetrics Systems, Inc.* v. *Tetra Tech, Inc.* (case 2:21-cv-1289) (Mar. 22, 2021).
MVTec Software GmbH, HALCON Solution Guide I: Basics, available at http://download.mvtec.com/halcon-10.0-solution-guide-i.pdf (2013)("HALCON Solution Guide").
National Instruments, NI Vision for LabVIEW User Manual, available at https://www.ni.com/pdf/manuals/371007b.pdf (2005) ("LabVIEW 2005 Manual").
Wenbin Ouyang & Bugao Xu, Pavement Cracking Measurements Using 3D Laser-Scan Images, 24 Measurement Sci. & Tech. 105204 (2013) ("Ouyang").
Chris Solomon & Toby Breckon, Fundamentals of Digital Image. Processing: A Practical Approach With Examples in Matlab (2011)("Solomon").
Çağlar Aytekin et al., Railway Fastener Inspection by Real-Time Machine Vision, 45 IEEE Transactions on Sys., Man, and Cybernetics: Sys. 1101 (Jan. 2015) ("Aytekin").

(56) References Cited

OTHER PUBLICATIONS

Jinfeng Yang et al., An Efficient Direction Field-Based Method for the Detection of Fasteners on High-Speed Railways, 11 Sensors 7364 (2011) ("Yang").
Urszula Marmol & Slawomir Mikrut, Attempts at Automatic Detection of Railway Head Edges from Images and Laser Data, 17 Image Processing & Commc'n 151 (2012) ("Marmol").
Xaxier Gibert-Serra et al., A Machine Vision System for Automated Joint Bar Inspection from a Moving Rail Vehicle, Droc. 2007 Asme/IEEE Joint Rail Conf. & Internal Combustion Engine Spring Tech. Conf. 289 (2007) ("Gibert-Serra").
SICK Sensor Intelligence, Product Catalog 2014/2015: Vision, available at https://www.sick.com/media/docs/2/02/302/Product_catalog_Vision_en_IM005 0302.PDF (2013) ("SICK Catalog").
SICK Sensor Intelligence, Application: 3D Vision for Cost-Efficient Maintenance of Rail Networks, TETRATECH_0062963-64 (Jan. 2015) ("SICK Article").
Matrox Electronic Systems, Ltd., Matrox Imaging Library version 9 User Guide, available at https://www.matrox.com/apps/imaging_documentation_files/mil_userguide.pdf (2008) ("Matrox MIL 9 User Guide").
MVTec Software GmbH, HALCON: the Power of Machine Vision, available at https://pyramidimaging.com/specs/MVTec/Halcon%2011.pdf (2013)("HALCON Overview").
Tordivel AS, Scorpion Vision Software: Version X Product Data, available at http://www.tordivel.no/scorpion/pdf/Scorpion%20X/PD-2011-0005%20Scorpion%20X%20Product%20Data.pdf (2010) ("Scorpion Overview").
OpenCV 3.0.0.-dev documentation, available at https://docs.opencv.org/3.0-beta/index.html (2014) ("OpenCV").
Mathworks Help Center, Documentation: edge, available https://www.mathworks.com/help/images/ref/edge.html (2011) ("Matlab").
National Instruments, NI Vision for LabVIEW Help, available https://www.ni.com/pdf/manuals/370281w.zip (2014) ("LabVIEW").
Intel Integrated Performance Primitives for Intel Architecture, Reference Manual, vol. 2: Image and Video Processing, available at http://www.nacad.ufrj.br/online/intel/Documentation/en_US/ipp/ippiman.pdf (Mar. 2009).
Andrew Shropshire Boddiford, Improving the Safety and Efficiency of Rail Yard Operations Using Robotics, UT Elec. Theses and Dissertations, available at http://hdl.handle.net/2152/2911 (2013).
Leszek Jarzebowicz & Slawomir Judek, 3D Machine Vision System for Inspection of Contact Strips in Railway Vehicle Durrent Collectors, 2014 Int'l Conf. on Applied Elecs. 139 (2014).
Peng Li, A Vehicle-Based Laser System for Generating High-Resolution Digital Elevation Models, K-State Elec. Theses, Dissertations, and Reports, available at http://hdl.handle.net/2097/3890 (2010).
Pavemetrics' Preliminary Invalidity Contentions in Case No. 2:21-cv-1289, dated Jul. 15, 2021.
Exhibits 2-9 to Pavemetrics' Preliminary Invalidity Contentions in Case No. 2:21-cv-1289, dated Jul. 15, 2021.
Pavemetrics' Invalidity Contentions and Preliminary Identification in Case No. 2:21-cv-1289, dated Sep. 13, 2021.
Exhibit 2 to ,Pavemetrics' Invalidity Contentions and Preliminary Identification in Case No. 2:21-cv-1289, dated Sep. 13, 2021.
Exhibit 3 to ,Pavemetrics' Invalidity Contentions and Preliminary Identification in Case No. 2:21-cv-1289, dated Sep. 13, 2021.
U.S. Patent and Trademark Office, Non-Final Office Action for U.S. Appl. No. 16/889,016 dated Sep. 23, 2021.
U.S. Patent and Trademark Office, Non-Final Office Action for U.S. Appl. No. 16/898,544 dated Sep. 24, 2021.
International Preliminary Report on Patentability, PCT App. No. PCT/US2020/033374 dated Nov. 16, 2021.

* cited by examiner

AUTONOMOUS TRACK ASSESSMENT SYSTEM

CROSS-REFERENCE TO RELATED APPLICATION

This application claims priority to U.S. Provisional Patent Application Ser. No. 62/848,630 for an "Autonomous Track Assessment System" filed on May 16, 2019, Provisional Patent Application Ser. No. 62/988,630 for an "Autonomous Track Assessment System" filed on Mar. 12, 2020, and Provisional Patent Application Ser. No. 63/016,661 for an "Autonomous Track Assessment System" filed on Apr. 28, 2020, and is a continuation-in-part and claims priority to U.S. application Ser. No. 16/255,928 for an "Apparatus and Method for Gathering Data From Sensors Oriented at an Oblique Angle Relative to a Railway Track" filed on Jan. 24, 2019, which is a continuation-in-part of and claims priority to U.S. application Ser. No. 16/127,956 entitled "APPARATUS AND METHOD FOR CALCULATING WOODEN CROSSTIE PLATE CUT MEASUREMENTS AND RAIL SEAT ABRASION MEASUREMENTS BASED ON RAIL HEAD HEIGHT" which was filed on Sep. 11, 2018, which claims priority to U.S. Provisional Patent Application Ser. No. 62/679,467 entitled "APPARATUS AND METHOD FOR CALCULATING WOODEN TIE PLATE CUT MEASUREMENTS AND RAIL SEAT ABRASION MEASUREMENTS" which was filed on Jun. 1, 2018, the entireties of which are incorporated herein by reference in their respective entireties.

FIELD

This disclosure relates to the field of railway track inspection and assessment systems. More particularly, this disclosure relates to a railway track inspection and assessment system and platform that is autonomous and includes various sensors oriented relative to a railway track for gathering data from the railway track.

BACKGROUND

Railway tracks must be periodically inspected to assess a condition of the railway track and various individual components of the track. Traditional methods and systems of assessing a railway track may require significant labor by on-track workers and require that sections of railway track be obstructed during assessment. Traditional methods of track inspection further enhance risk for on-track workers and may slow or prevent other traffic along a section of railway track during inspection, such as when a section of railway track is occupied by hi-rail based systems.

Further, current track assessment systems require significant resources to operate and to review data captured from assessment of a section of railway track. Existing systems may only be able to capture limited stretches of a railway track at a given time, further increasing costs and an amount of time required to assess sections of railway track. Existing systems may further suffer from drawbacks including obstructions to sensors by debris building up on optics of the sensors or by extreme conditions, such as extreme temperatures or temperature variations along a section of railway track.

What is needed, therefore, is a railway track inspection and assessment system and platform that is autonomous and that prevents obstruction of sensors, such as by debris on the railway track.

SUMMARY

Embodiments herein include a railway track inspection and assessment system and platform that is autonomous and that prevents obstruction of sensors, such as by debris on the railway track. In a first aspect, an autonomous railway track assessment apparatus for gathering, storing, and processing profiles of one or both rails on a railway track includes: railway track assessment platform including a boxcar including an enclosed space formed therein; one or more power sources located on the boxcar; a controller in electrical communication with the one or power sources including at least one processor and a data storage device in communication with the processor; a first sensor assembly in electronic communication with the controller, the first sensor assembly including a first sensor enclosure, a light emitting device, and one or more first sensors oriented to capture data from the railway track; an air handling system located on the rail car, the air handling system including an air blower and a heater/chiller; and a set of air ducts in fluid communication with the air handling system and the first sensor assembly for supplying heated or cooled blown air from the air from the handling system to the first sensor assembly. Data from the railway track is autonomously collected by the first sensor assembly controlled by the controller and such data is stored on the data storage device.

In one embodiment, the autonomous railway track assessment apparatus further includes: a second sensor assembly in electronic communication with the controller, the second sensor assembly including a second sensor enclosure, a second light emitting device, and one or more second sensors oriented to capture data from the railway track; the set of air ducts in fluid communication with the air handling system, the first sensor assembly, and the second sensor assembly for supplying heated or cooled blown air from the air handling system to the first sensor assembly and the second sensor assembly. Data from the railway track is autonomously collected by both the first sensor assembly controlled by the controller and the second sensor assembly controlled by the controller and such data is stored on the data storage device.

In another embodiment, the first sensor assembly is oriented at a substantially perpendicular angle relative to the railway track. In yet another embodiment, the second sensor assembly is oriented at an oblique angle $\alpha$ relative to the undercarriage of the rail vehicle.

In one embodiment, the autonomous railway track assessment apparatus further includes a first LiDAR sensor configured to gather data of a rail corridor along a first scan plane and a second LiDAR sensor configured to gather data of a rail corridor along a second scan plane wherein the first LiDAR sensor and the second LiDAR sensor are in electrical communication with the controller and are physically connected to on an outer rear surface of the boxcar.

In another embodiment, the autonomous railway track assessment apparatus further includes a temperature controller in communication with the air handling system wherein the blower and heater/chiller are activated or deactivated by the temperature controller based on environmental conditions of the autonomous railway track assessment apparatus.

In yet another embodiment, the autonomous railway track assessment apparatus further includes one or more valves within ducts between the air handling system and each of the first sensor assembly and the second sensor assembly.

In a second aspect, an air handling system for an autonomous track assessment apparatus includes: a railroad data gathering assembly including a sensor and a light emitter inside a sensor enclosure wherein the railroad data gathering assembly is operable to gather data from a railroad track using the sensor and the light emitter; an air blower; a heater/chiller in fluid communication with the air blower; a temperature controller in electronic communication with the air blower and the heater/chiller; a temperature sensor in communication with the temperature controller. The temperature controller activates and deactivates the air blower and heater/chiller to provide conditioned air to the railroad data gathering assembly based on data received from the temperature sensor wherein the conditioned air is blown out of the sensor enclosure proximate to the sensor and the light emitter to divert debris or precipitation from the sensor and the light emitter.

In one embodiment, the air handling system for an autonomous track assessment apparatus further includes: at least one sensor assembly comprising a LiDAR sensor mounted on an outer surface of a rail car; the air handling system further including at least one duct formed through a side of the rail car for communicating air from the air blower and heater/chiller to the at least one sensor assembly.

In another embodiment, the LiDAR sensor further including a LiDAR sensor housing having a plurality of apertures formed therethrough for emitting air from the air handling system towards a sensor surface of the LiDAR sensor. In yet another embodiment, the plurality of apertures are arranged radially around the LiDAR sensor housing.

In one embodiment, the LiDAR sensor housing further includes at least one camera located on the LiDAR sensor housing, wherein air flowing through the LiDAR sensor housing towards the plurality of apertures passes proximate to a lens of the at least one camera.

In another embodiment, air from the air blower passes through a computer hardware rack prior to passing through the sensor enclosure.

In a third aspect, an air handling system for an autonomous track assessment apparatus includes: a railroad data gathering assembly including a LiDAR sensor mounted on a LiDAR sensor housing on a boxcar, the LiDAR sensor housing including a plurality of apertures formed therethrough proximate to sensors of the LiDAR sensor; an air blower; a heater/chiller in fluid communication with the air blower; a temperature controller in electronic communication with the air blower and the heater/chiller; a temperature sensor in communication with the temperature controller. The temperature controller activates and deactivates the air blower and heater/chiller to provide conditioned air to the railroad data gathering assembly based on data received from the temperature sensor wherein the conditioned air is blown out of the sensor enclosure proximate to the sensor and the light emitter to divert debris or precipitation from the sensor and the light emitter.

In one embodiment, air from the air blower passes through a computer hardware rack prior to passing through the sensor enclosure.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

"Track", "Railway track", "track bed", "rail assembly", or "railway track bed" is defined herein to mean a section of railway including the rails, crossties (or "ties"), components holding the rails to the crossties, components holding the rails together, and ballast material.

A "processor" is defined herein to include a processing unit including, for example, one or more microprocessors, an application-specific instruction-set processor, a network processor, a vector processor, a scalar processor, or any combination thereof, or any other control logic apparatus now known or later developed that is capable of performing the tasks described herein, or any combination thereof.

The phrase "in communication with" means that two or more devices are in communication with one another physically (e.g., by wire) or indirectly (e.g., by wireless communication).

When referring to the mechanical joining together (directly or indirectly) of two or more objects, the term "adjacent" means proximate to or adjoining. For example, for the purposes of this disclosure, if a first object is said to be attached "adjacent to" a second object, the first object is either attached directly to the second object or the first object is attached indirectly (i.e., attached through one or more intermediary objects) to the second object.

Figure 1:
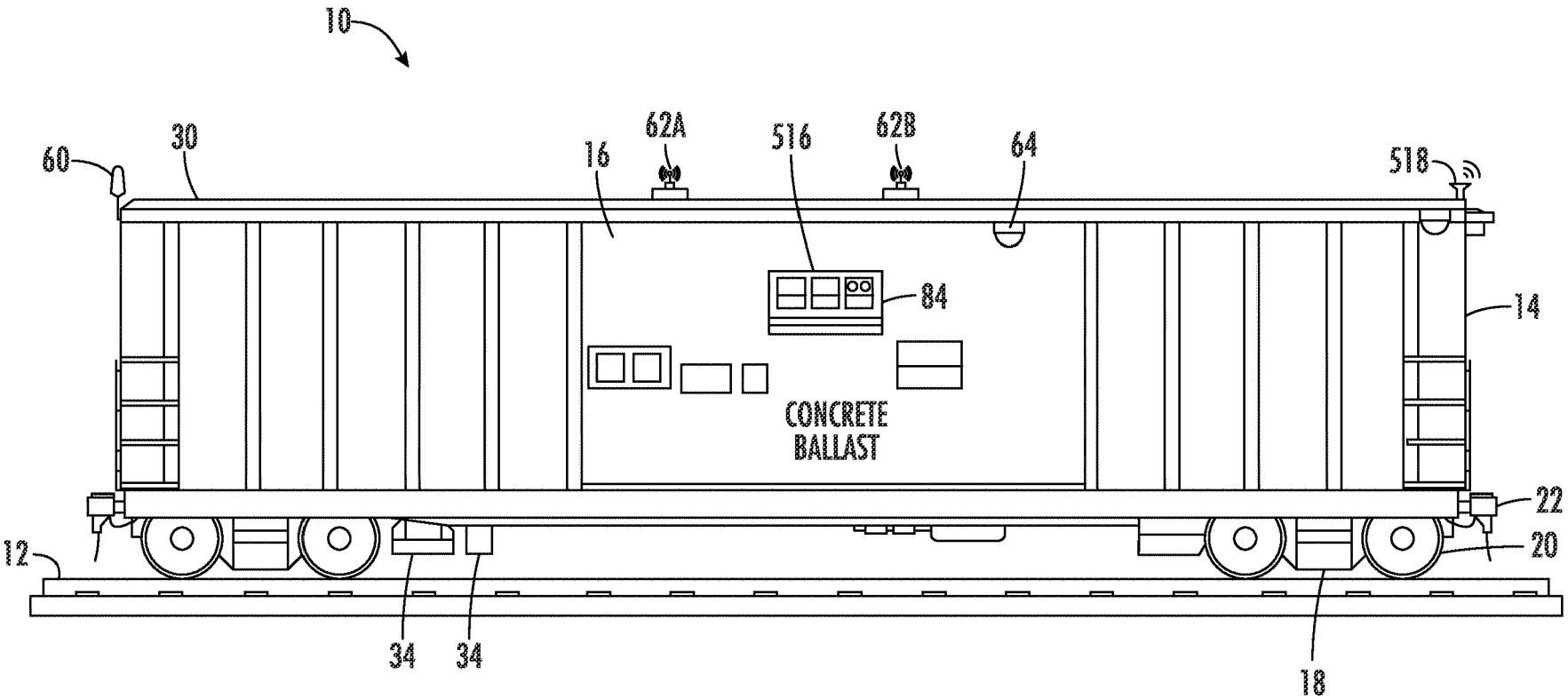
FIG. 1 shows a side view of an autonomous track assessment system according to one embodiment of the present disclosure.

Referring to FIG. 1, embodiments herein include an autonomous track assessment platform 10 for inspecting railway track 12 and components thereof. The autonomous track assessment platform 10 provides for a fully integrated autonomous platform capable of inspecting sections of a railway track. The autonomous track assessment platform 10 is capable of inspecting and gathering data from long stretches of the railway track 12 and high speeds and of providing real-time reporting and archiving of data collected from the railway track 12.

Embodiments of the autonomous track assessment platform 10 include a boxcar 14 on which a plurality of sensor systems are installed as discussed in greater detail below. The boxcar 14 includes an enclosed space 16 located within the boxcar 14 for housing various sensor components and hardware discussed in greater detail below. The boxcar 14 may have dimensions substantially similar to a common boxcar or a hi-roof boxcar typically used to carry freight or other items. The boxcar 14 is preferably suspended on bogies 18 including pairs of wheels 20 that allow the boxcar 14 to travel along the railway track 12. The boxcar 14 further preferably includes couplings 22 located at opposing ends of the rail car 14 such that the railcar 14 may be secured at either or both ends to a locomotive or other railcars of a train. The boxcar 14 may include ballast, such as a ballast concrete slab, to improve stability of the rail car 14.

Figure 2:
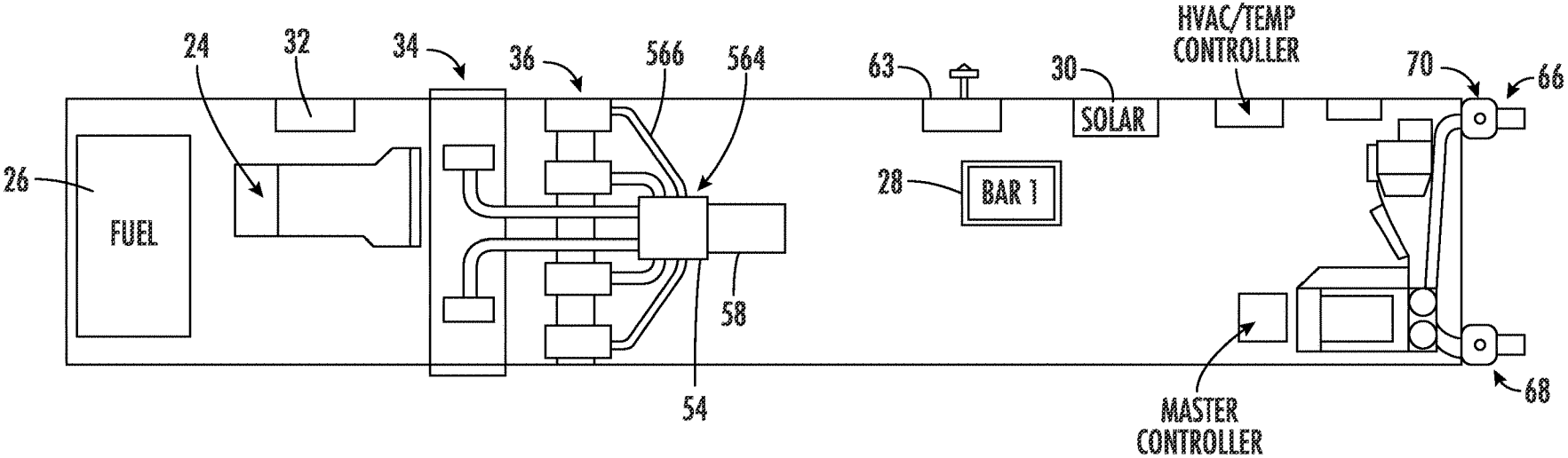
FIG. 2 shows a schematic view of an autonomous track assessment system according to one embodiment of the present disclosure.

Referring now to FIG. 2, the autonomous track assessment platform 10 preferably includes a plurality of sensor assemblies mounted on the boxcar 14 for capturing data for the assessment of a condition of the railway track 12 as the boxcar 14 travels along the railway track 12. In one embodiment, a plurality of sensor assemblies and other hardware components are installed on the autonomous track assessment platform 10 for automatically capturing data related to conditions of the railway track 12 and a surrounding environment without requiring substantial human intervention or labor to assess the railway track 12.

In one embodiment, the autonomous track assessment platform 10 includes an onboard power supply for powering various sensors and hardware components of the autonomous track assessment platform 10. A power supply is preferably onboard the track assessment platform 10 such that the autonomous track assessment platform 10 may be operated independent of a train to which the boxcar 14 is connected. For example, an electrical generator 24 may be located on the boxcar along with a fuel source 26 for powering the electrical generator 24. Additional power supply components may be included such as one or more batteries 28. The one or more batteries 28 may be in electrical communication with the electrical generator 24. One or more solar panels 30 may be mounted on the rail car 14 and in electrical communication with the one or more batteries 28. A power controller 32 is in electrical communication with the electrical generator 24, one or more batteries 28, and the one or more solar panels 30 for managing generation, storage, and distribution of electricity to components of the autonomous track assessment platform 10.

The autonomous track assessment platform 10 preferably includes a plurality of sensors and sensor assemblies for gathering data from the railway track 12 for further assessment and determination of a condition of the railway track 12 and surrounding objects. Various sensor assemblies may be mounted below the boxcar 14 and oriented towards the railway track 12 such that the sensor assemblies capture data from the railway track 12. Sensors may further be mounted on other external surfaces of the boxcar 14 for capturing data from the railway track 12 and a rail corridor including objects located around the railway track.

In one embodiment, a first sensor assembly 34 is mounted on the boxcar 14 for assessing a condition of the railway track 12 on which the boxcar 14 is travelling. The first sensor assembly 34 preferably includes a 3D Track Assessment System or "3DTAS" available from Tetra Tech, Inc. and disclosed in U.S. Patent Application Publication Number 2016/0249040 for a "3D Track Assessment System and Method," the contents of which are incorporated herein by reference in their entirety. The first sensor assembly 34 is directed straight down towards the railway track 12 and components thereof.

Figure 3:
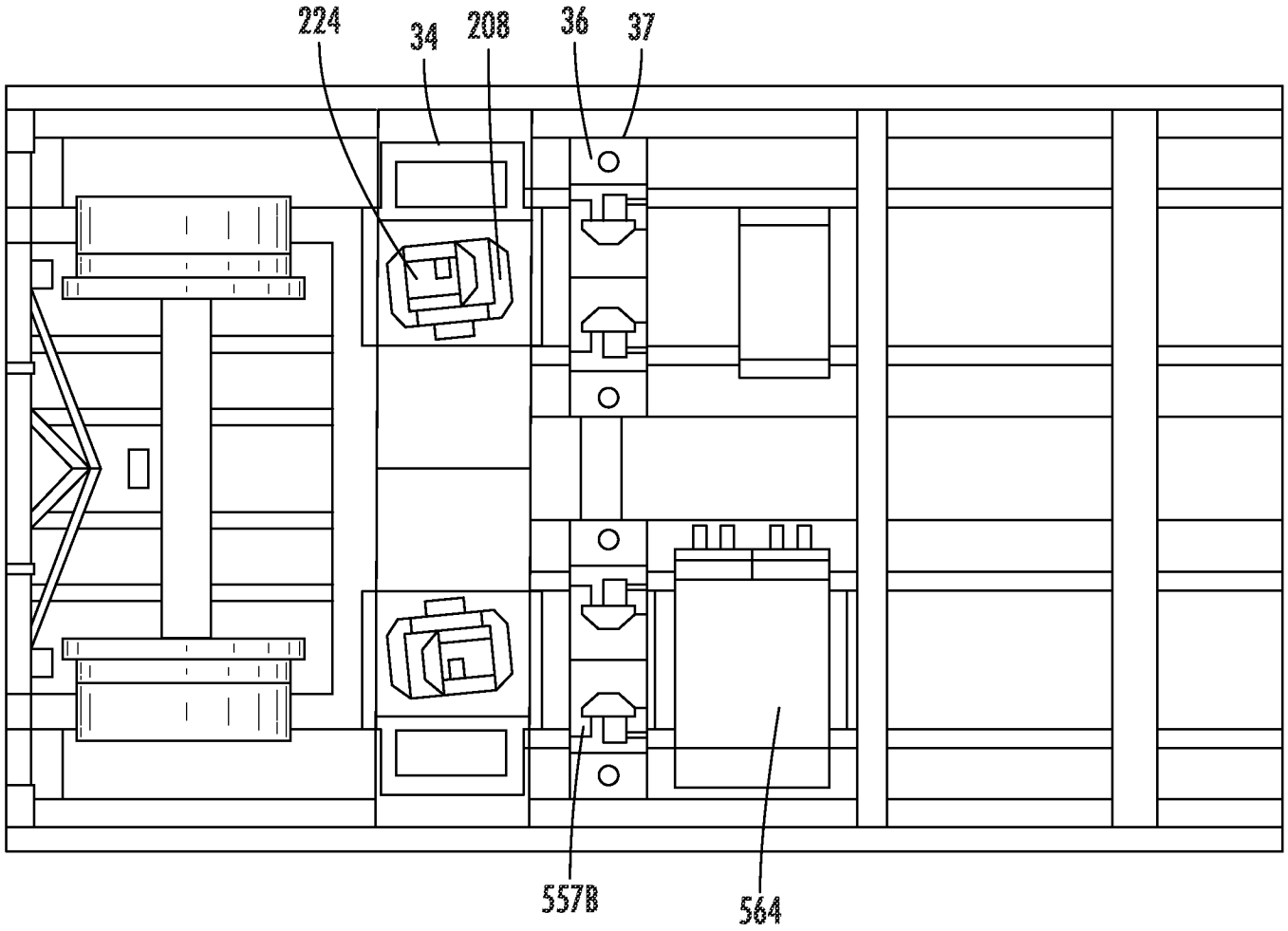
FIG. 3 shows a bottom view of an autonomous track assessment system according to one embodiment of the present disclosure.
Figure 4:
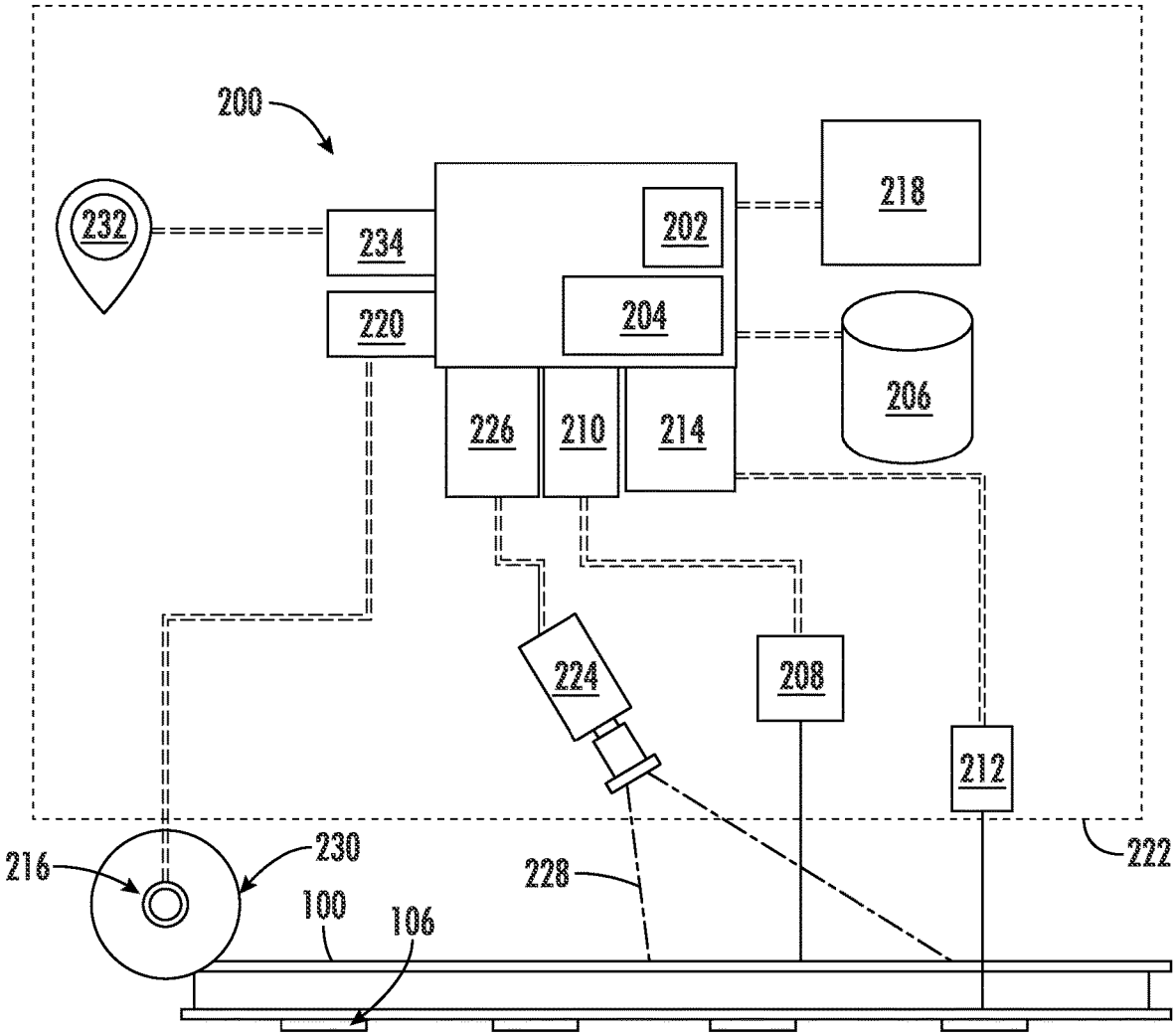
FIG. 4 shows a sensory assembly of an autonomous track assessment system according to one embodiment of the present disclosure.

Referring to FIG. 3, the first sensor assembly 34 includes a sensor housing 36 including a shroud 37 mounted underneath the boxcar 14 containing one or more sensors that are oriented to capture the railway track 12 as the boxcar 14 moves along the railway track 12. As shown in FIG. 4, the first sensor assembly may include components of a track assessment system 200 preferably including a processor 202, an onboard computer readable storage medium 204, a data storage device 206 in communication with the processor 202, computer executable instructions stored on one of the onboard computer readable storage medium 204 or the data storage device 206, optionally one or more light emitters 208 (e.g., a laser line emitter) via an optional light emitter interface 210, one or more sensors 212 in communication with the processor 202 via a sensor interface 214, and an optional wheel mounted shaft encoder 216 in communication with the processor 202 via an optional encoder interface 220. In a preferred embodiment, the one or more sensors 212 are Time of Flight ("ToF") sensors. However, it is also understood that various other suitable sensors including three-dimensional or "3D" sensors 212 may be used. The track assessment system 200 further preferably includes a display and user interface 218 in communication with the processor 202 to display data to or receive input from an operator. Components of the track assessment system 200 are preferably mounted on the boxcar 14 of the autonomous track assessment system 10. The track assessment system 200 may be powered by the boxcar 14 or may be powered by a battery or other local power source. The data storage device 206 may be onboard the boxcar 14 or may be remote from the vehicle, communicating wirelessly with the processor 202.

For embodiments employing one or more light emitters 208, such light emitters 208 are used to project a light, preferably a laser line, onto a surface of an underlying rail assembly to use in association with three-dimensional sensors to three-dimensionally triangulate the rail assembly. In a preferred embodiment, a camera 224 in communication with the processor 202 via a camera interface 226 is oriented such that a field of view 228 of the camera 224 captures the rail assembly including the light projected from the light emitter 208. The camera 224 may include a combination of lenses and filters and using known techniques of three-dimensional triangulation a three-dimensional elevation map of an underlying railway track bed can be generated by the processor 202 after vectors of elevations are gathered by the camera 224 as the boxcar 14 moves along the rail. Elevation maps generated based on the gathered elevation and intensity data can be interrogated by the processor 202 or other processing device using machine vision algorithms. Suitable cameras and sensors may include commercially available three-dimensional sensors and cameras, such as three-dimensional cameras manufactured by SICK AG based in Waldkirch, Germany.

ToF sensors are preferably based on pulsed laser light or LiDAR technologies. Such technologies determine the distance between the sensor and a measured surface by calculating an amount of time required for a light pulse to propagate from an emitting device, reflect from a point on the surface to be measured, and return back to a detecting device. The ToF sensors may be a single-point measurement device or may be an array measurement device, commonly referred to as a ToF camera, such as those manufactured by Basler AG or pmdtechnologies AG.

Figure 5:
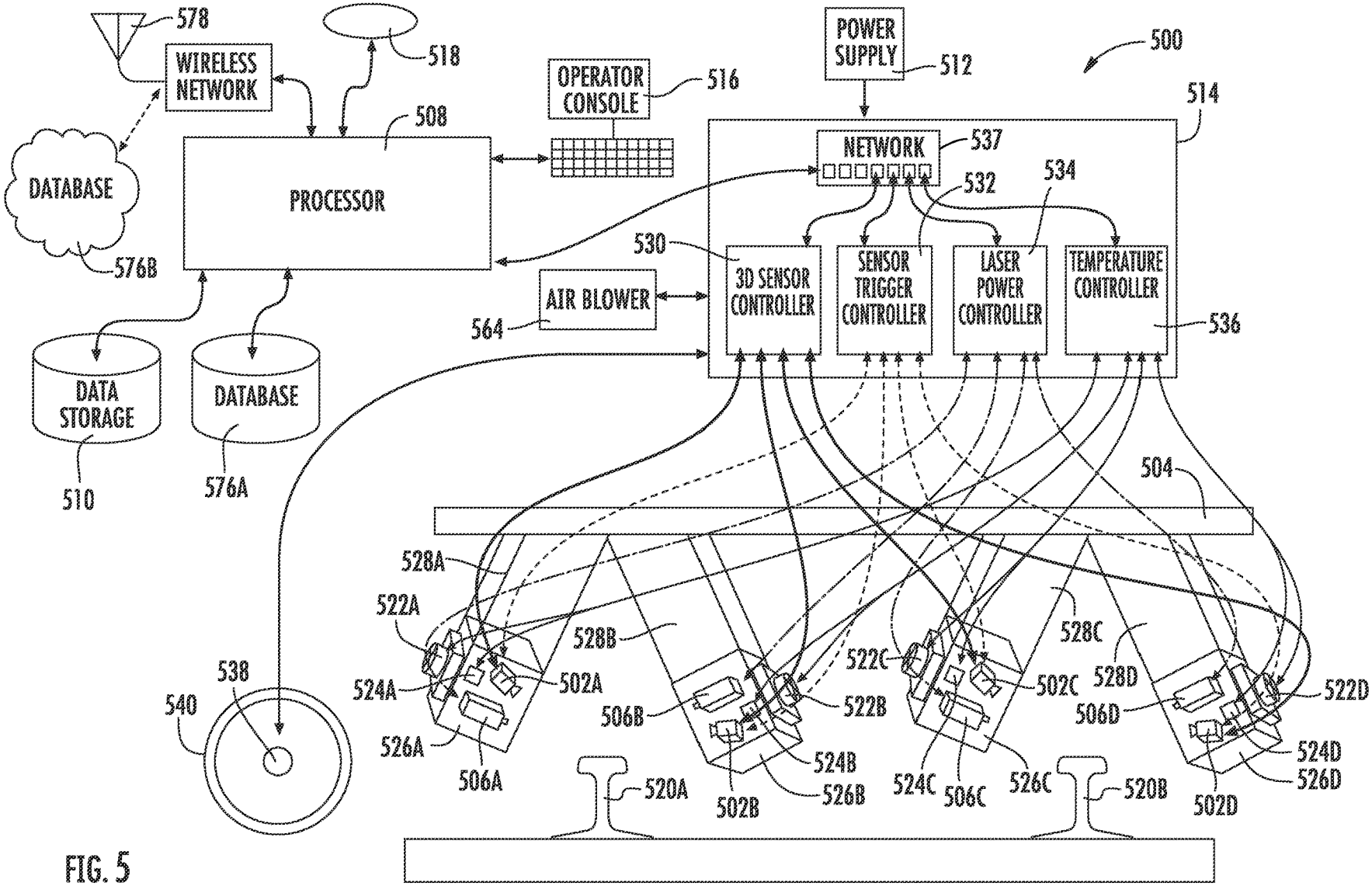
FIG. 5 shows a schematic diagram of a sensor assembly of an autonomous track assessment system including sensors oriented at an oblique angle which are capable of gathering data from rail webs and sides of rails.

Referring again to FIG. 2, a second sensor assembly 36 is mounted on the rail car 14 for assessing a condition of the railway track 12 on which the rail car 14 is travelling. The second sensor assembly 36 preferably includes one or more sensors oriented at an oblique angle relative to the railway track 12 to capture side view of the railway track. An exemplary embodiment of the second sensor assembly 36 is shown in FIG. 5, which may include components of a 3D track assessment system 500 and can be used as shown schematically in FIG. 5 which includes a plurality of 3D sensors 502 wherein the system 500 and sensors 502 are attached adjacent to a rail vehicle 504 configured to move along a railway track. The sensors 502 are oriented downward from the rail vehicle 504 but at an oblique angle looking at a rail from the side as shown in FIG. 5. Suitable sensors may include commercially available 3D sensors and cameras, such as Ranger cameras manufactured by SICK AG based in Waldkirch, Germany. The 3D track assessment system 500 further includes a plurality of structured light generators 506 (similar or identical to light emitters 208). The 3D track assessment system uses a combination of sensors 502, structured light generators 506, a specially configured processor 508, a data storage device 510, a power supply 512, a system controller 514, an operator interface 516, and a Global Navigation Satellite System (GNSS) receiver 518. Although single components are listed, it is understood that more than one of each component may be implemented in the 3D track assessment system 500 including, for example, more than one processor 508 and more than one controller 514. These and other system components help provide a way to gather high resolution profiles of the sides of rails including the heads, the bases and rail webs of rails 520 (including a first rail 520A and a second rail 520B) on a railway track. The 3D sensors 502 are preferably configured to collect four high resolution substantially vertical profiles at programmable fixed intervals as the system 500 moves along a railway track. The current implementation can collect 3D profiles (or scanlines) every 1.5 millimeters (mm) while the autonomous track assessment system 10 is moving along the railway track 12 at speeds up to 70 miles per hour. The system autonomously monitors sensor 502 operation, controls and configures each sensor 502 independently, and specifies output data storage parameters (directory location, filename, etc.). The system 500 further provides rail web manufacturer mark inventory capabilities, and various rail features inventory, exception identification and reporting capabilities. Typical exceptions include rail head and joint bar defects or dimensional anomalies. When identified, these exceptions can be transmitted based on specific thresholds using exception prioritization and reporting rules.

Figure 6:
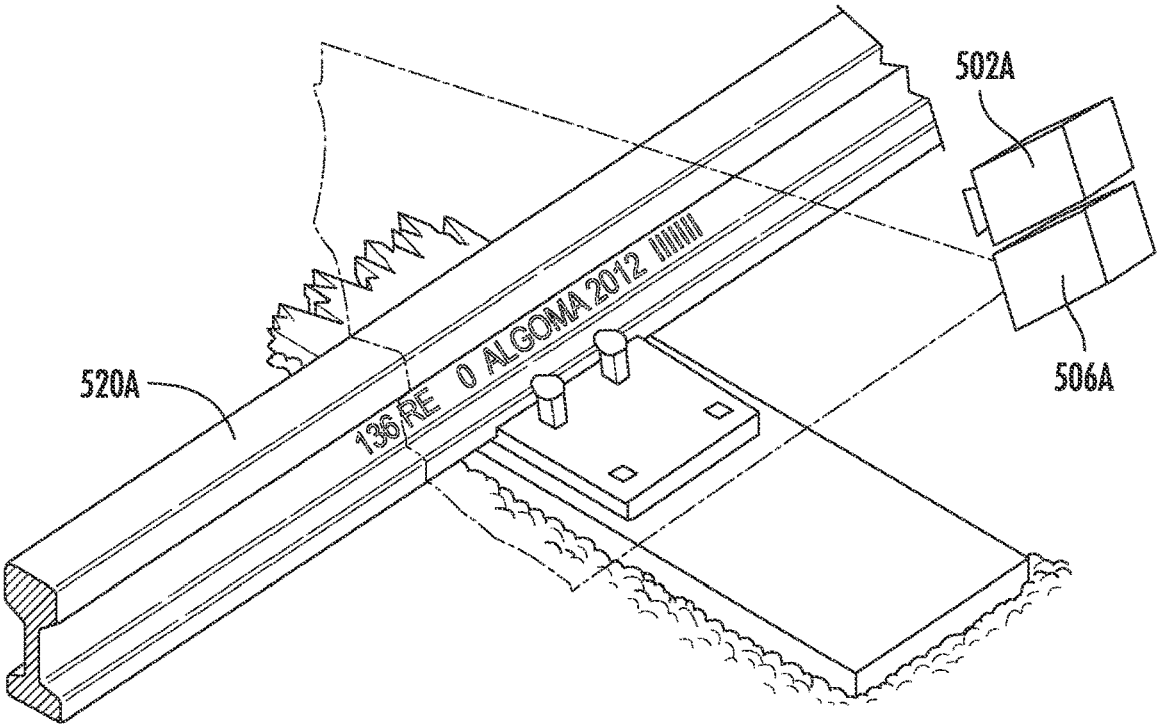
FIG. 6 shows a schematic of a 3D sensor and light emitter oriented at an oblique angle, gathering data from the side of a rail.
Figure 7:
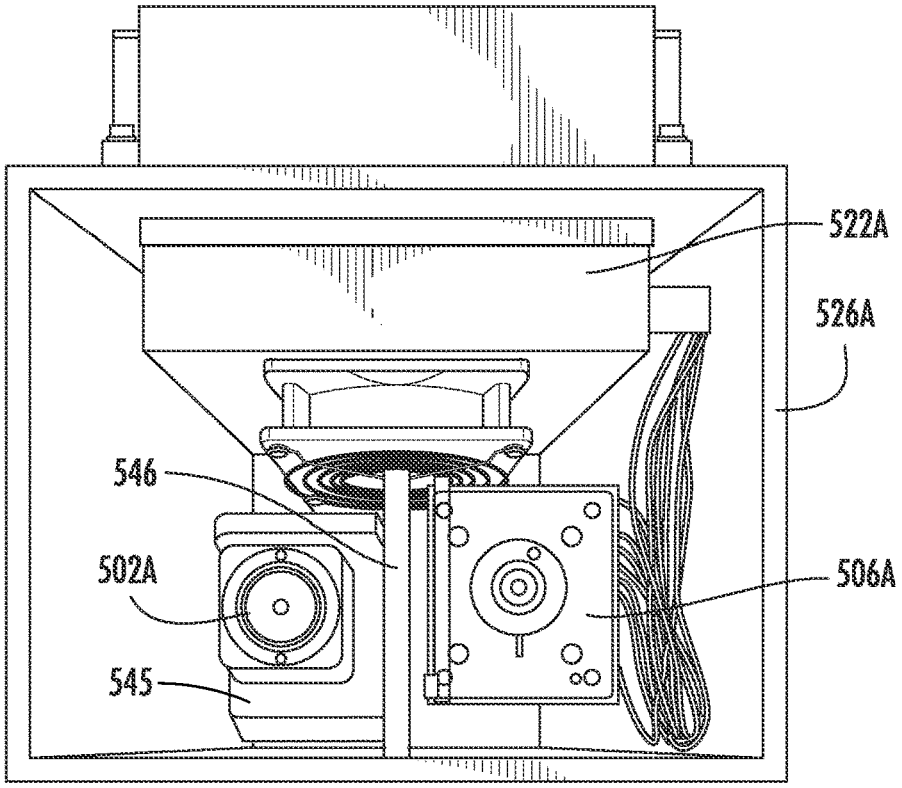
FIG. 7 shows a sensor enclosure including a sensor and a light emitter attached adjacent to an internal frame inside the sensor enclosure as well as a heating and cooling device for maintaining the operating temperature inside the sensor enclosure to within specific temperature limits.

In a preferred embodiment, the 3D track assessment system 500 includes a first sensor 502A, a first structured light generator 506A, a first heating and cooling device 522A (e.g., solid state or piezo electric), and a first thermal sensor 524A all substantially sealed in a first enclosure 526A forming part of a first sensor pod 528A; a second sensor 502B, a second structured light generator 506B, a second heating and cooling device 522B, and a second thermal sensor 524B all substantially sealed in a second enclosure 526B forming part of a second sensor pod 528B; a third sensor 502C, a third structured light generator 506C, a third heating and cooling device 522C, and a third thermal sensor 524C all substantially sealed in a third enclosure 526C forming part of a third sensor pod 528C; and a fourth sensor 502D, a fourth structured light generator 506D, a fourth heating and cooling device 522D, and a fourth thermal sensor 524D all substantially sealed in a fourth enclosure 526D forming part of a fourth sensor pod 528D. FIG. 6 shows an image of the first sensor 502A and the first light generator 506A (without the first enclosure 526A for illustrative purposes) oriented at an oblique angle to the plane of the railway track bed surface allowing a view of the side of the first rail 520A. FIG. 7 shows the first sensor 502A, the first light generator 506A, and the first heating and cooling device 522A inside the first enclosure 526A.

The controller 514 further includes a 3D sensor controller 530 in communication with the 3D sensors 502, a sensor trigger controller 532 in communication with the 3D sensors 502, a structured light power controller 534 in communication with the structured light generators 506, and a temperature controller 536 in communication with the heating and cooling devices 522 and the thermal sensors 524. The system controller 514 further includes a network interface 537 in communication with the processor 508 and the 3D sensor controller 530, sensor trigger controller 532, structured light power controller 534, and the temperature controller 536. The triggering for the 3D sensors 502 is generated by converting pulses from an encoder 538 (e.g., a quadrature wheel encoder attached adjacent to a wheel 540 on the survey rail vehicle 504 wherein the encoder 538 is capable of generating 12,500 pulses per revolution, with a corresponding direction signal) using the dedicated sensor trigger controller 532, a component of the dedicated system controller 514, which allows converting the very high resolution wheel encoder pulses to a desired profile measurement interval programmatically. For example, the wheel 540 could produce encoder pulses every 0.25 mm of travel and the sensor trigger controller 532 would reduce the sensor trigger pulse to one every 1.5 mm and generate a signal corresponding to the forward survey direction, or a different signal for a reverse survey direction.

The configuration of the four 3D sensors 502 and light generators 506 ensure that the complete rail profile is captured by combining the trigger synchronized left and right 3D sensor profiles of both rails 520 on a railway track simultaneously to produce a single combined scan for each rail. These scans can be referenced to geo-spatial coordinates using the processor 508 by synchronizing the wheel encoder 538 pulses to GNSS receiver positions acquired from the GNSS satellite network (e.g., GPS). This combined rail profile and position reference information can then be saved in the data storage device 510.

The 3D sensors 502 and structured light generators 506 are housed in the substantially sealed watertight enclosures 526. Because of the heating and cooling devices 522, thermal sensors 524, and the dedicated temperature controller 536, the inside of the enclosures 526 can be heated when the ambient temperature is below a low temperature threshold and cooled when the ambient air temperature is above a high temperature threshold. The thermal sensors 524 provide feedback to the temperature controller 536 so that the temperature controller can activate the heating function or the cooling function of the heating and cooling devices on an as-needed basis. These sealed and climate-controlled enclosures 526 ensure the correct operation and extend the operational life of the sensitive sensors 502 and light generators 506 by maintaining a clean and dry environment within acceptable ambient temperature limits. The temperature control function is part of the system controller 514 with a dedicated heating and cooling device interface inside each enclosure.

Figure 8:
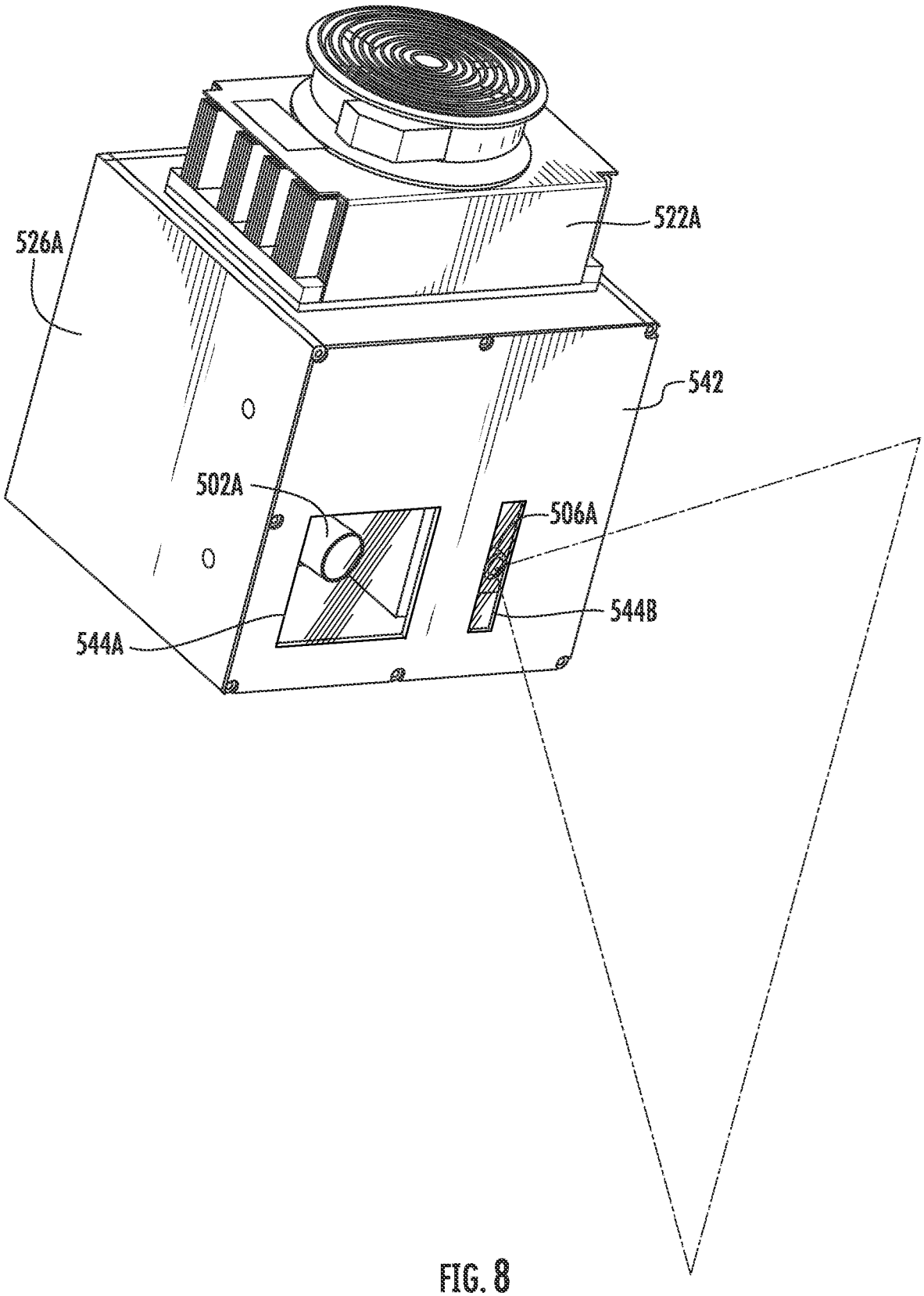
FIG. 8 shows the sensor enclosure of FIG. 7 including a cover plate covering the sensor and the light emitter and enclosing the sensor enclosure.
Figure 9A:
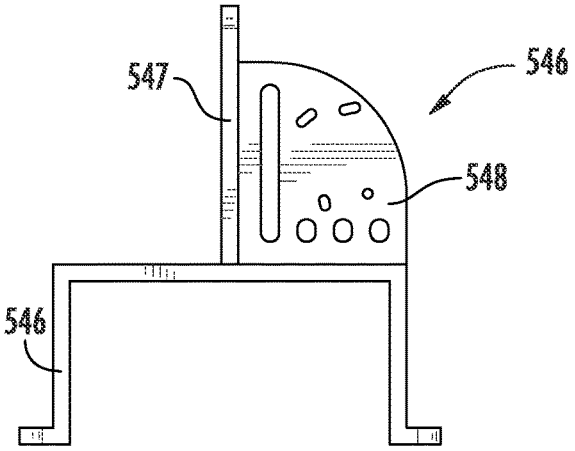
FIG. 9A shows a side view of the internal frame from FIG. 7 which is located inside the sensor enclosure.
Figure 9B:
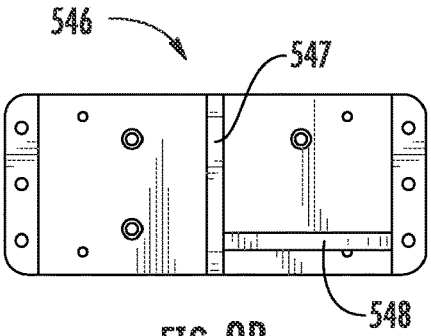
FIG. 9B is a plan view of the internal frame shown in FIG. 9A.
Figure 9C:
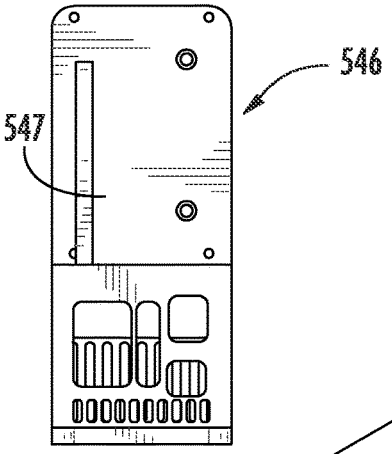
FIG. 9C shows an end view of the internal frame shown in FIGS. 9A and 9B.
Figure 9D:
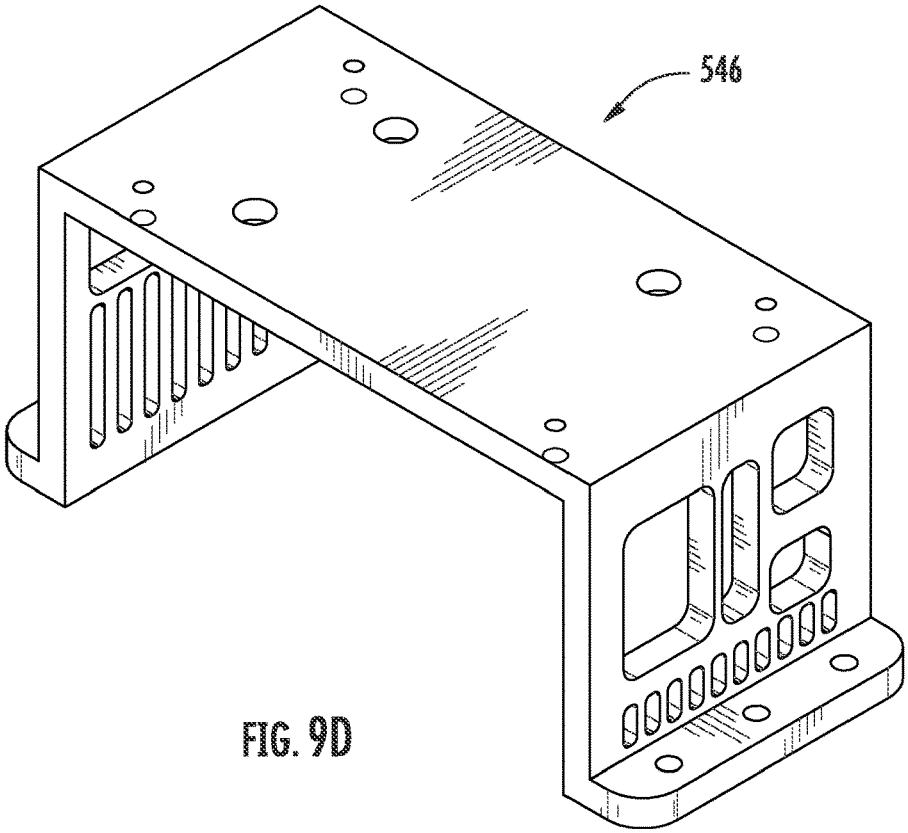
FIG. 9D shows a frame base which forms the base of the internal frame shown in FIGS. 9A-9C.

FIG. 8 shows the first enclosure 526A including a cover plate 542 forming one side of the first enclosure 526A. The cover plate 542 includes a first cover plate aperture 543A through which the first sensor 502A views outside of the first enclosure 526A and a second cover plate aperture 543B through which the light generator casts light outside of the first enclosure 526A. The first cover plate aperture 544A is covered by a first glass panel 544A and the second cover plate aperture 544B is covered by a second glass panel 544B. The glass panels 544 are preferably impact resistant and have optical transmission characteristics that are compatible with the wavelengths of the light generators 506. This helps avoid broken aperture glass and unnecessary heat buildup inside the enclosures 526 from light reflected back into the enclosures 526 during operation. The first sensor 502A and the first light generator 506A are preferably mounted to an internal frame 545 preferably using bolts. The frame 545 is shown in FIG. 9A-9C and such frame is preferably bolted to the inside of the first enclosure 526A. The frame 545 includes a frame base 546 (shown by itself in FIG. 9D), a laser alignment panel 547 to which the first structured light generator 506A is attached, and a sensor alignment panel 548 to which the first 3D sensor 502A is attached. Each additional enclosure (526B, 526C, and 526D) includes a cover plate (like the cover plate 542) with apertures (like the apertures 544) as well as a frame (like the frame 545) for attaching and optically aligning sensors and light generators together inside the enclosures.

Figure 10:
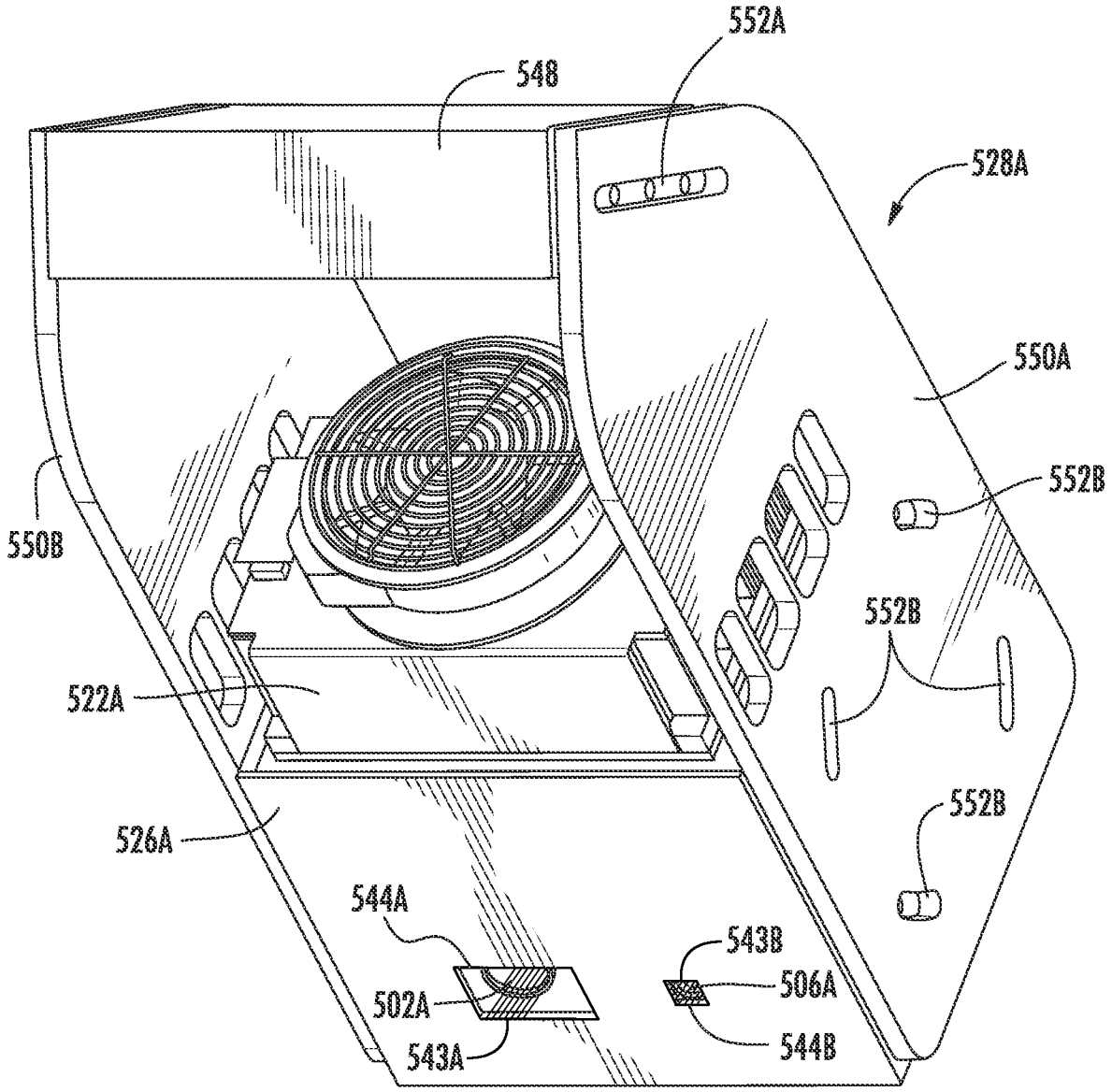
FIG. 10 shows a sensor pod including the sensor enclosure confined therein.
Figure 11A:
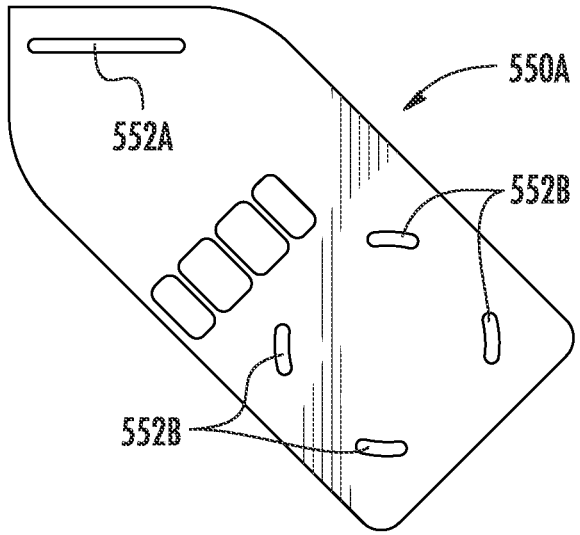
FIG. 11A shows a first side bracket of the sensor pod.
Figure 11B:
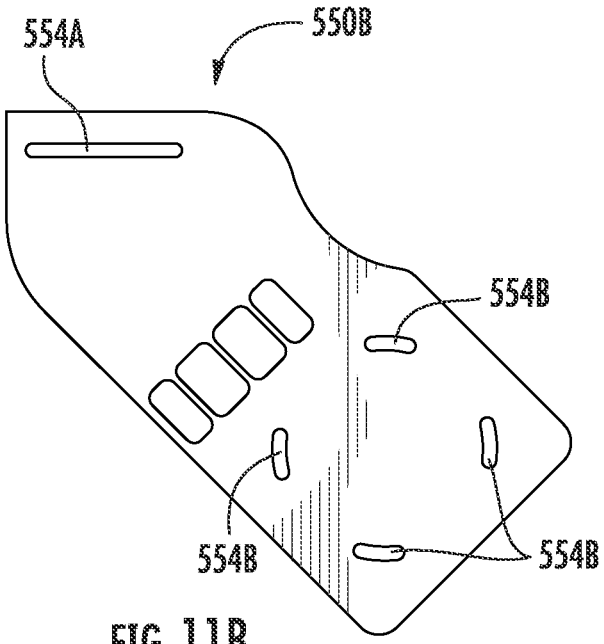
FIG. 11B shows a second side bracket of the sensor pod.
Figure 12:
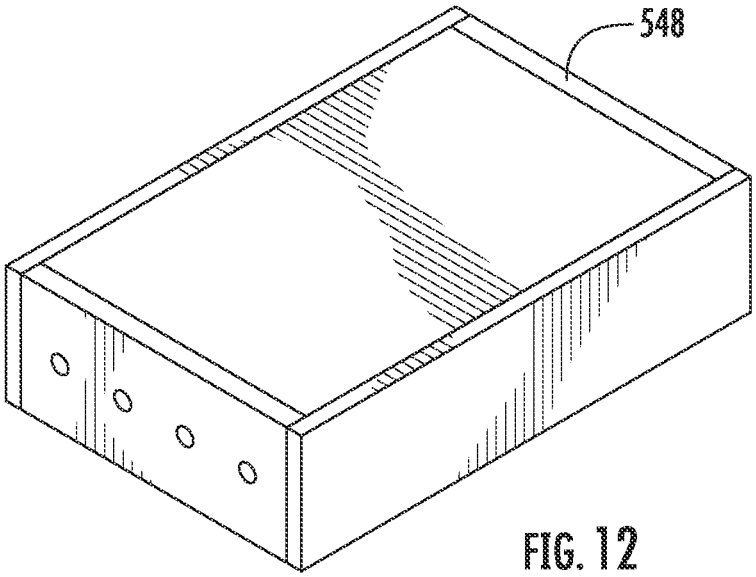
FIG. 12 shows a sill mount of the sensor pod which is used to engage sensor pod with the undercarriage of a rail vehicle.
Figure 13:
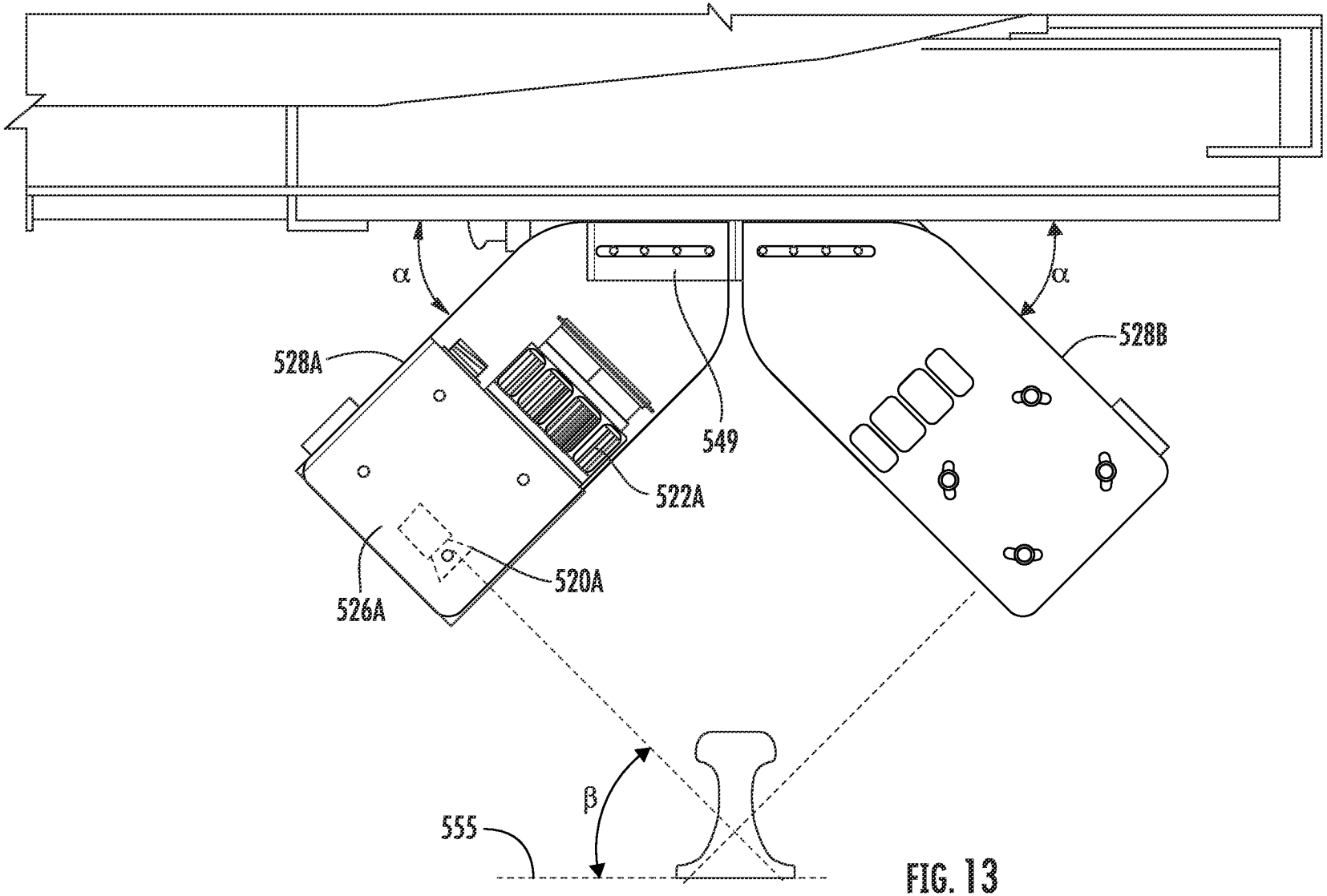
FIG. 13 shows a pair of sensor pods oriented at oblique angles $\alpha$ on either side of a rail so that data can be gathered from both sides of the rail.

FIG. 10 shows the first sensor pod 528A including the first enclosure 526A. The first sensor pod 528 includes a sill mount 548 and side brackets 550 (including a first side bracket 550A shown in FIG. 11A and a second side bracket 550B shown in FIG. 11B). The sill mount 548 is shown by itself in FIG. 12. The sill mount 548 is preferably attached adjacent to the undercarriage of the rail vehicle 504 by mechanical fastening using bolts or welding the sill mount 548 directly to the rail vehicle undercarriage. The first side bracket 550A is attached adjacent to the sill mount 548 preferably by bolts through a first side bracket first aperture 552A, and the second side bracket 550B is attached adjacent to the sill mount 548 preferably by bolts through a second side bracket first aperture 554A. The first enclosure 526A is attached adjacent to the side brackets 550 preferably using bolts through first side bracket second apertures 552B and second side bracket second apertures 554B extending into tapped holes on the sensor enclosure. As an example, the first side bracket second apertures 552B are elongated so that the first enclosure 526A can be rotated plus or minus up to about 5° relative to the side brackets 550 before being bolted, screwed or otherwise attached tightly adjacent to the side brackets 550. The flexibility to slightly rotate the first enclosure 526A inside the first pod 528A is helpful to compensate for mounting height variations which can occur from rail vehicle to rail vehicle since not all vehicles are the same height. FIG. 13 shows the first sensor pod 528A and the second sensor pod 528B attached adjacent to the undercarriage of the rail vehicle 504 in a configuration that allows for data to be gathered from both sides of the first rail 520A using a combination of the first sensor 502A and the second sensor 502B. In FIG. 13, the first side bracket 550A is removed to show the first enclosure 526A. The orientation of the sensor pods 528 is at an angle $\alpha$ relative to the undercarriage of the rail vehicle 504. Angle $\alpha$ preferably ranges from about 10° to about 60°, more preferably from about 25° to about 55°, and most preferably from about 40° to about 50°. The value for a in FIG. 13 is about 45°. The lowest point of the first sensor pod is preferably at least 75 mm above the rail being scanned by the first sensor 502A. The first sensor 502A is oriented at an oblique angle $\theta$ relative to the railway track bed surface 555 wherein angle $\theta$ preferably ranges from about 30° to about 60° and more preferably from about 40° to about 50°.

Figure 14A:
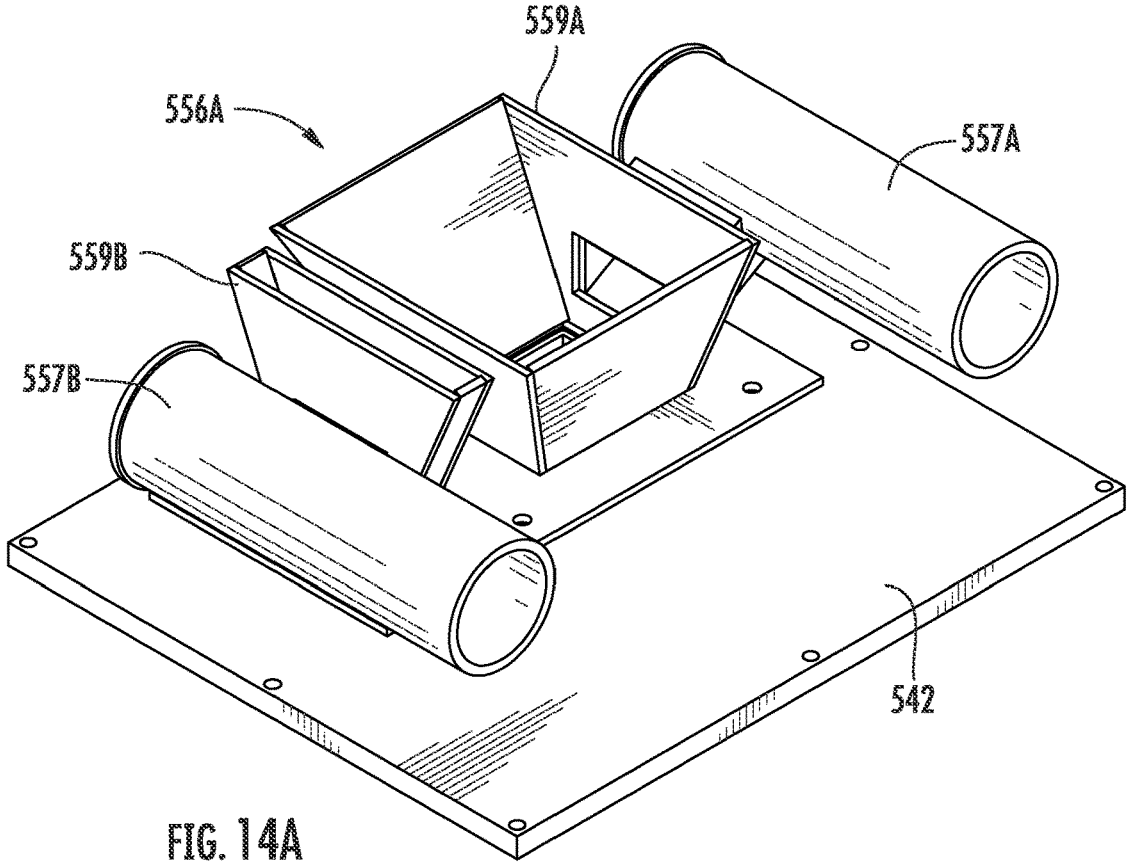
FIG. 14A shows a perspective view of an air distribution lid for covering the cover plate from FIG. 10 and providing air flow to such cover plate to remove debris from cover plate glass panels through which the sensor has a field of view and through which the light emitter emits light.
Figure 14B:
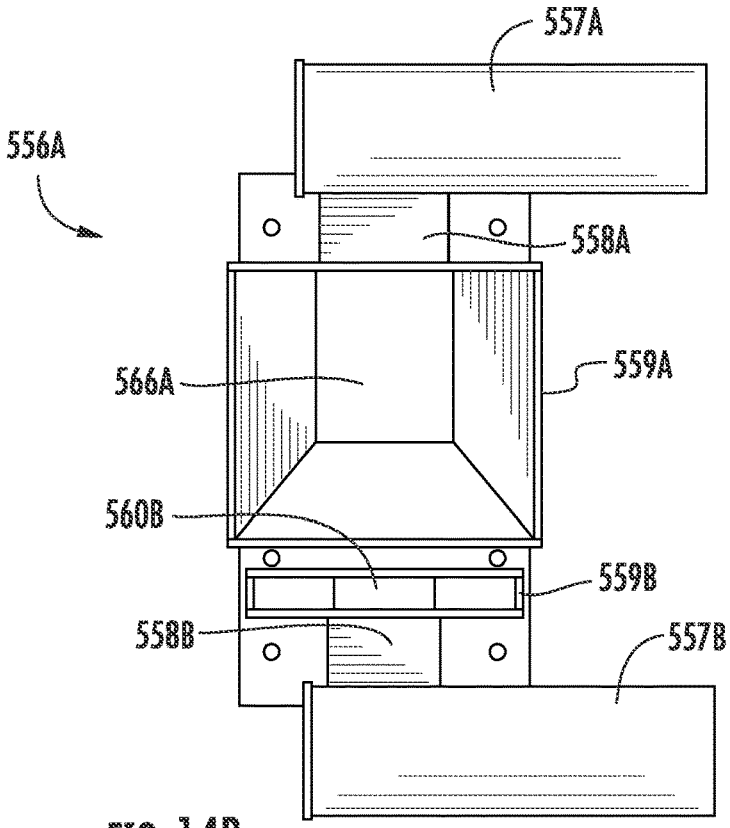
FIG. 14B shows a plan view of the air distribution lid from FIG. 14A.
Figure 14C:
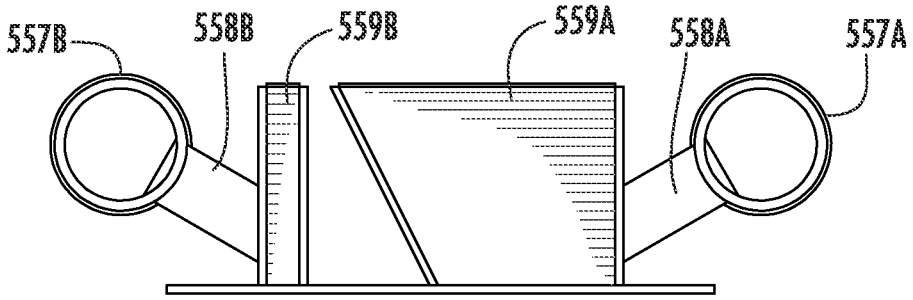
FIG. 14C shows an end view of the air distribution lid shown in FIGS. 14A-14B.
Figure 14D:
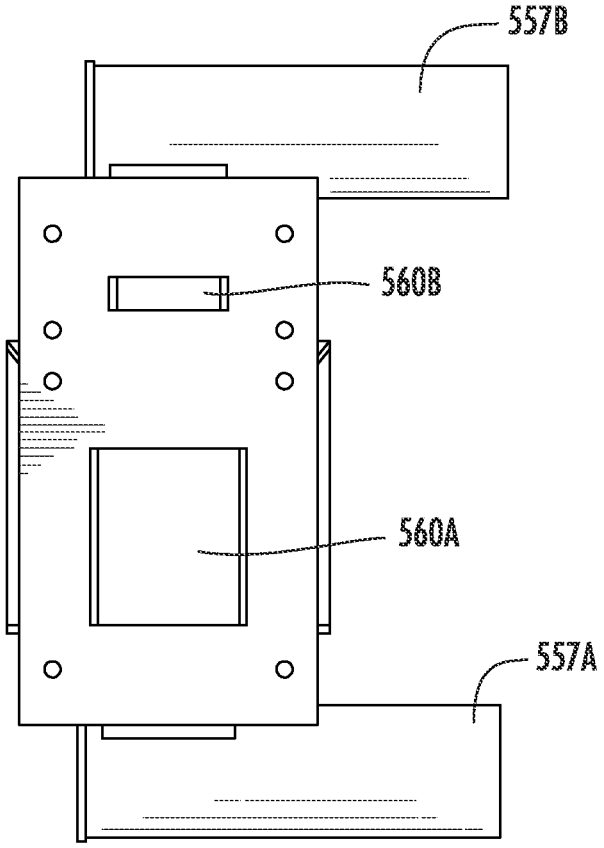
FIG. 14D shows a bottom view of the air distribution lid shown in FIGS. 14A-14C.
Figure 15:
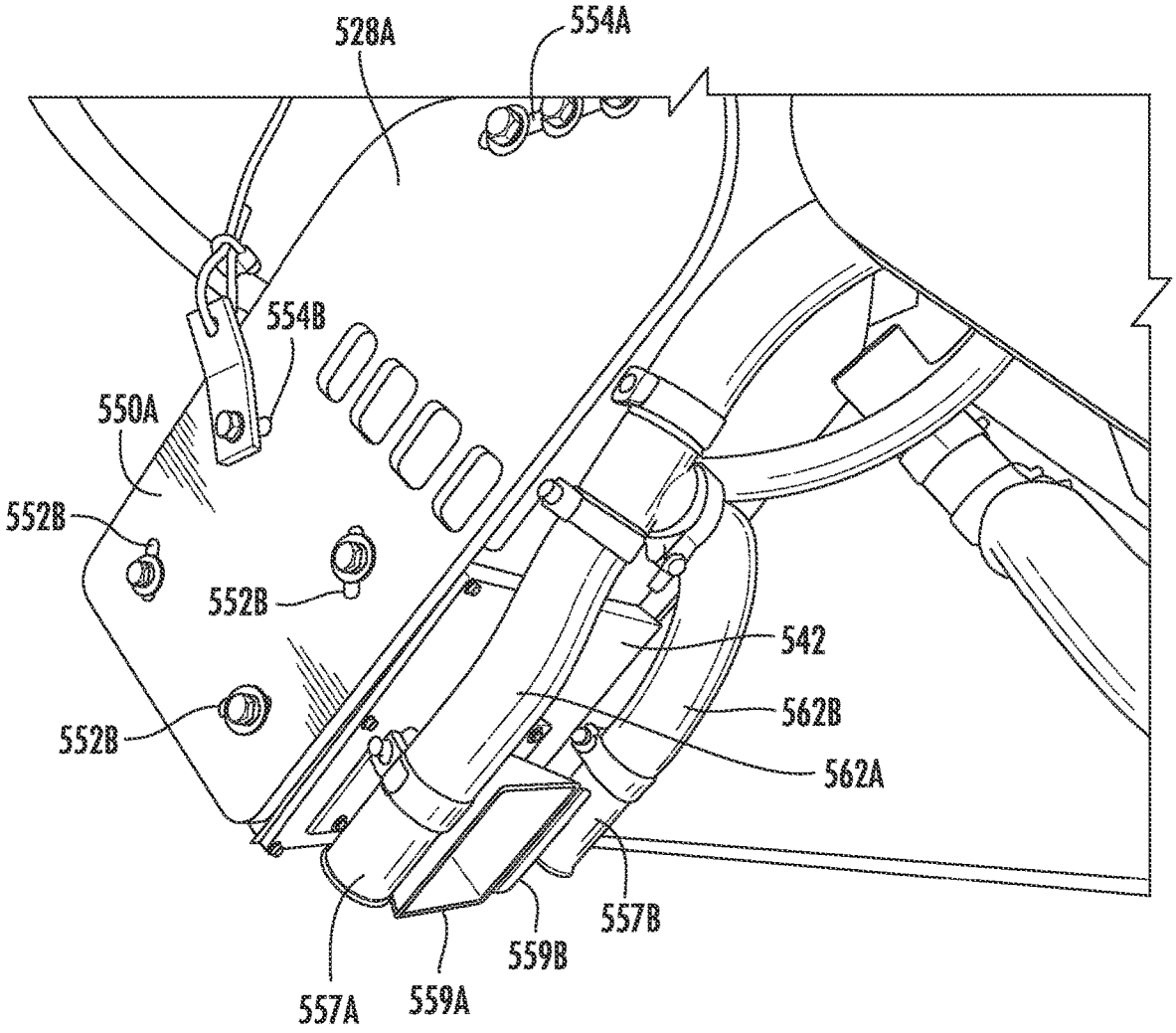
FIG. 15 shows a sensor pod including the air distribution lid from FIGS. 14A-14D attached adjacent to the cover plate of the sensor enclosure from FIG. 10 wherein ducts are attached adjacent to the air distribution lid.
Figure 16:
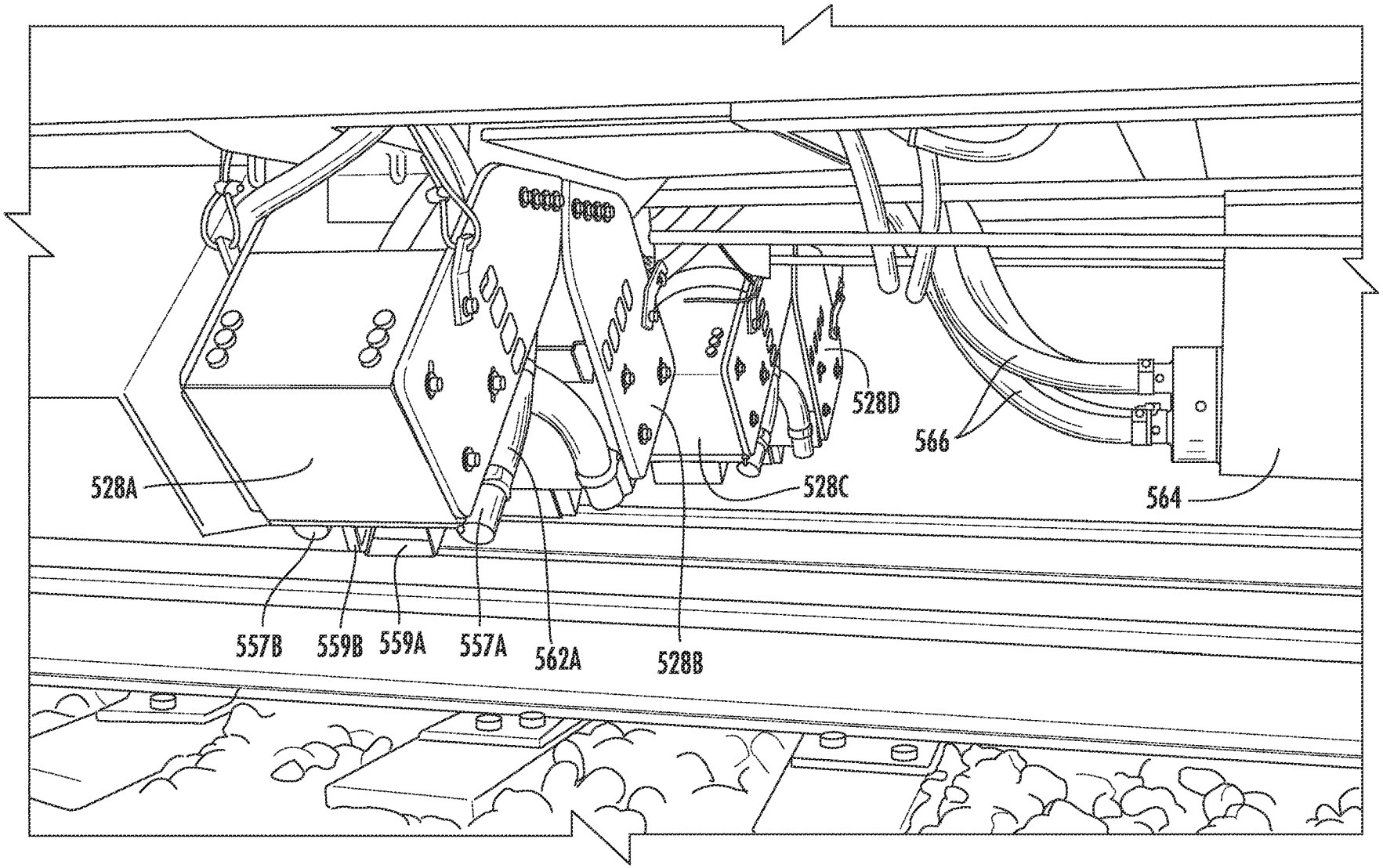
FIG. 16 shows an array of four sensor pods, each pod including an air distribution lid, wherein each air distribution lid is receiving air flow through a plurality of ducts originating from an air blower.
Figure 17:
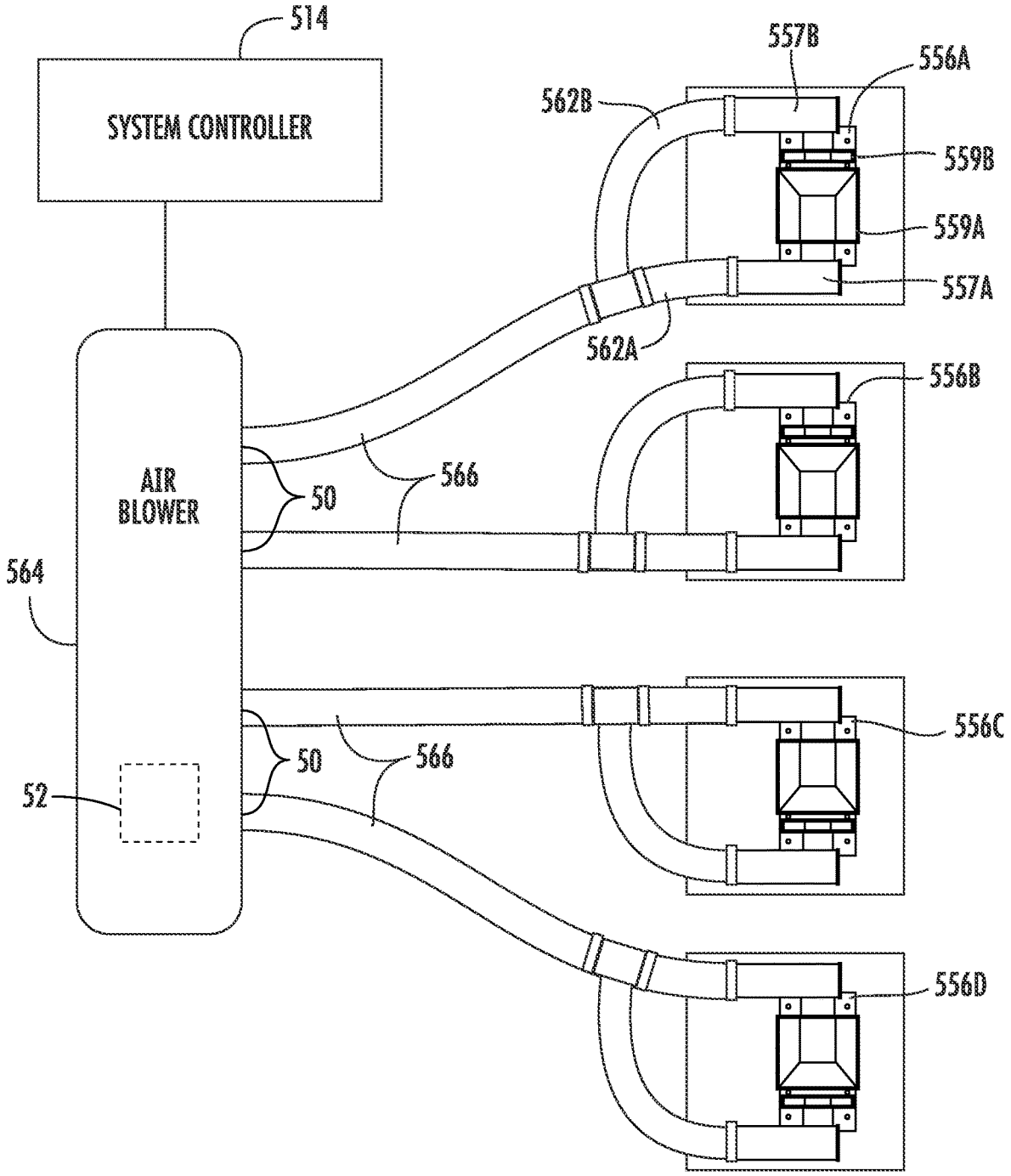
FIG. 17 shows a schematic of the air blower from FIG. 16 and the plurality of ducts leading to the various air distribution lids.

FIG. 14A shows the cover plate 542 with a first air distribution lid 556A attached adjacent to the cover plate 542 preferably by bolts or screws. FIG. 14B-14D show different views of the first air distribution lid 556A by itself. The first air distribution lid 556A includes a first duct mount 557A which directs air through a first enclosed channel 558A to a first walled enclosure 559A at an area proximate to a first air distribution lid first aperture 560A which overlaps the first cover plate aperture 544A. The first air distribution lid 556A includes a second duct mount 557B which directs air through a second enclosed channel 558B to a second walled enclosure 559B at an area proximate to a second air distribution lid second aperture 560B which overlaps the second cover plate aperture 544B. FIG. 15 shows a perspective view of the first sensor pod 528A including the cover plate 542 and the first air distribution lid 556A. A first air duct 562A is engaged with the first duct mount 557A to supply air to the first walled enclosure 559A. A second air duct 562B is engaged with the second duct mount 557B to supply air to the second walled enclosure 559B. FIG. 16 shows a full array of the sensor pods 528 and shows an air blower 564 supplying air through a plurality of ducts 566. FIG. 17 shows schematically how air is supplied from the air blower 564 to the first air distribution lid 556A, a second air distribution lid 556B, a third air distribution lid 556C, and a fourth air distribution lid 556D. The air blower 564 is in communication with the system controller 514 so that when the 3D sensors 502 are activated, the system controller 514 causes the air blower 564 to be activated also. The air flowing through the plurality of ducts 566 to the air distribution lids 556 is used to clear debris from the area proximate to the enclosure cover plate apertures through which the sensors 502 view rails and through which the light generators 506 shine light. As the rail vehicle 504 moves along a railway track, debris that would otherwise cover the view of the sensors 502 or block the light of the light generators 506 is dislodged by the air flow through the air distribution lids 556.

Figure 18:
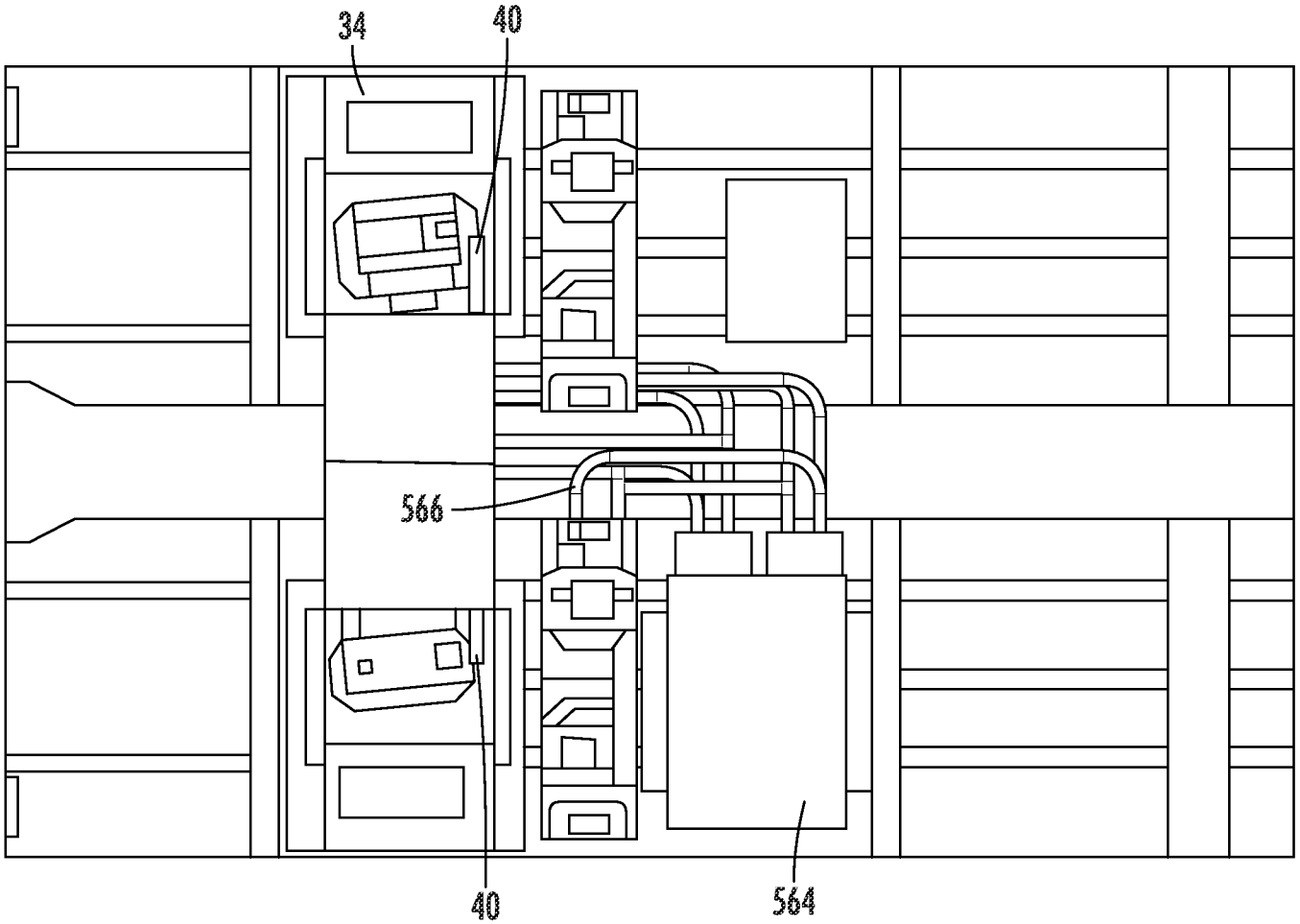
FIG. 18 shows a close-up bottom view of an autonomous track assessment system according to one embodiment of the present disclosure.
Figure 19:
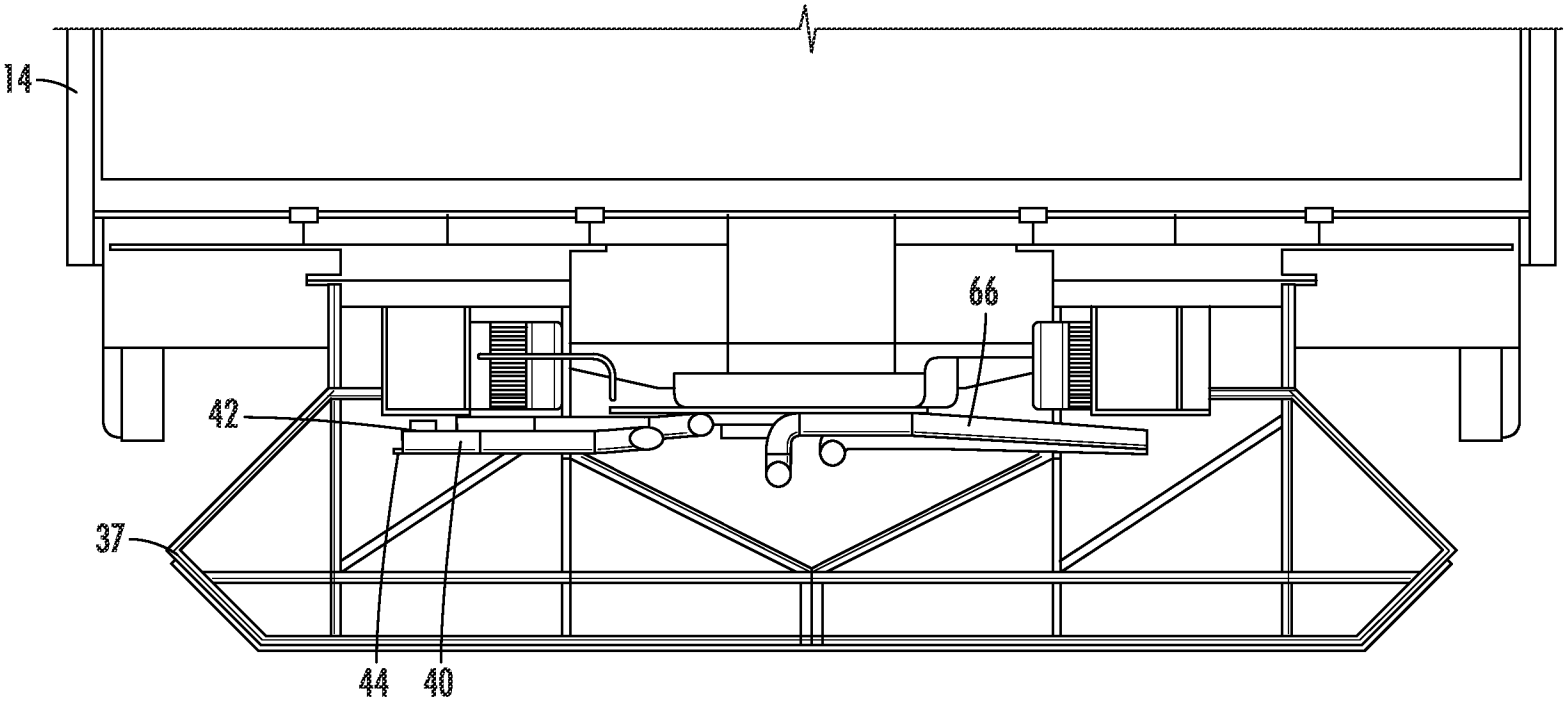
FIG. 19 shows a side view of a sensor assembly of an autonomous track assessment system according to one embodiment of the present disclosure.
Figure 20:
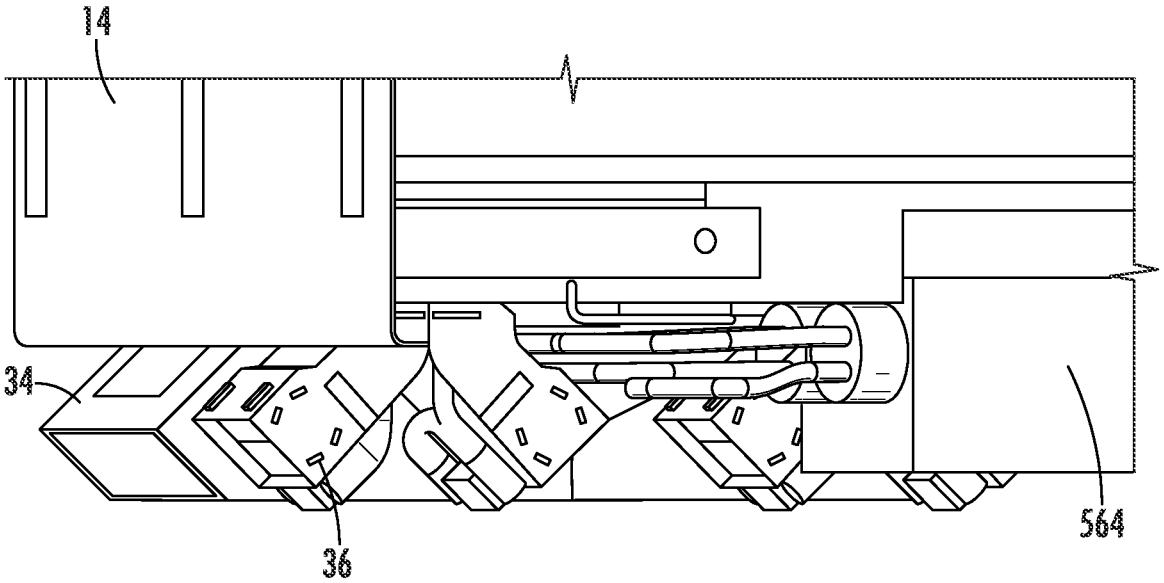
FIGS. 20 and 21 show a first sensor assembly, a second sensor assembly, and a blower of an autonomous track assessment system according to one embodiment of the present disclosure.
Figure 21:
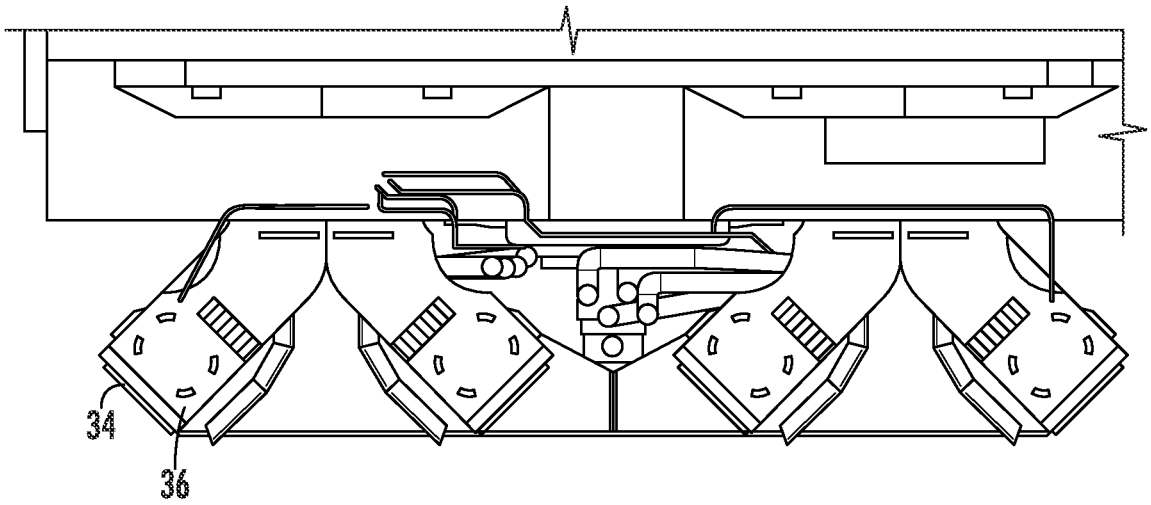

Referring now to FIG. 18, one or more of the plurality of air ducts 566 are further in fluid communication with the first sensor assembly 34 for directing air from the air blower 564 towards sensors of the first sensor assembly 34. The plurality of air ducts 566 in fluid communication with the first sensor assembly 34 are connected to a plurality of duct mounts 40A and 40B of the first sensor assembly 34. As shown in FIGS. 18-19, the plurality of duct mounts 40 are in fluid communication with enclosed channels 42. Enclosed channels 42 are in fluid communication with walled ducts 44. Walled ducts 44 are located proximate to windows or lenses of the sensors on the enclosure 48 containing the one or more light emitters 208 and the camera 224 of the first sensor assembly 34 such that air flowing through the enclosed channels 42 the walled ducts 44 is substantially directed towards the sensors of the first sensor assembly 34.

The air blower 564 preferably includes a plurality of outlets 50 for connecting the plurality of ducts 566 to the air blower 564. For example, the air blower 564 may include a number of outlets 50 corresponding to a number of sensors on both the first sensor assembly 34 and the second sensor assembly 36 such that air from the air blower 564 is imparted proximate to sensors of the first sensor assembly 34 and the second sensor assembly 36. The air blower 564 preferably includes a blower motor 52 located within a blower housing 54. The blower motor 52 is in fluid communication with the plurality of outlets 50.

The air blower 564 further preferably includes a chiller/heater 58 (FIG. 2) for heating or cooler air through the air blower 564. The chiller/heater 58 is preferably in fluid communication with the air blower 564 such that air from the air blower 564 provided to the first sensor assembly 34 and the second sensor assembly 36 may be heated or cooled depending on external environmental conditions. The chiller/heater 58 may be in electronic communication with a controller, such as the temperature controller 536 (FIG. 5) for controlling a heated or cooled temperature of air through the air blower 564.

Figure 23:
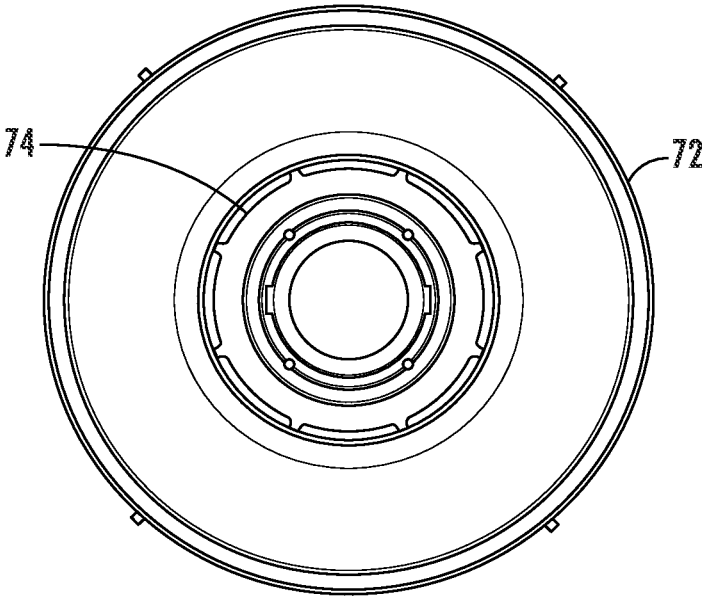
FIG. 23 shows an end view of a LiDAR sensor enclosure according to one embodiment of the present disclosure.
Figure 24:
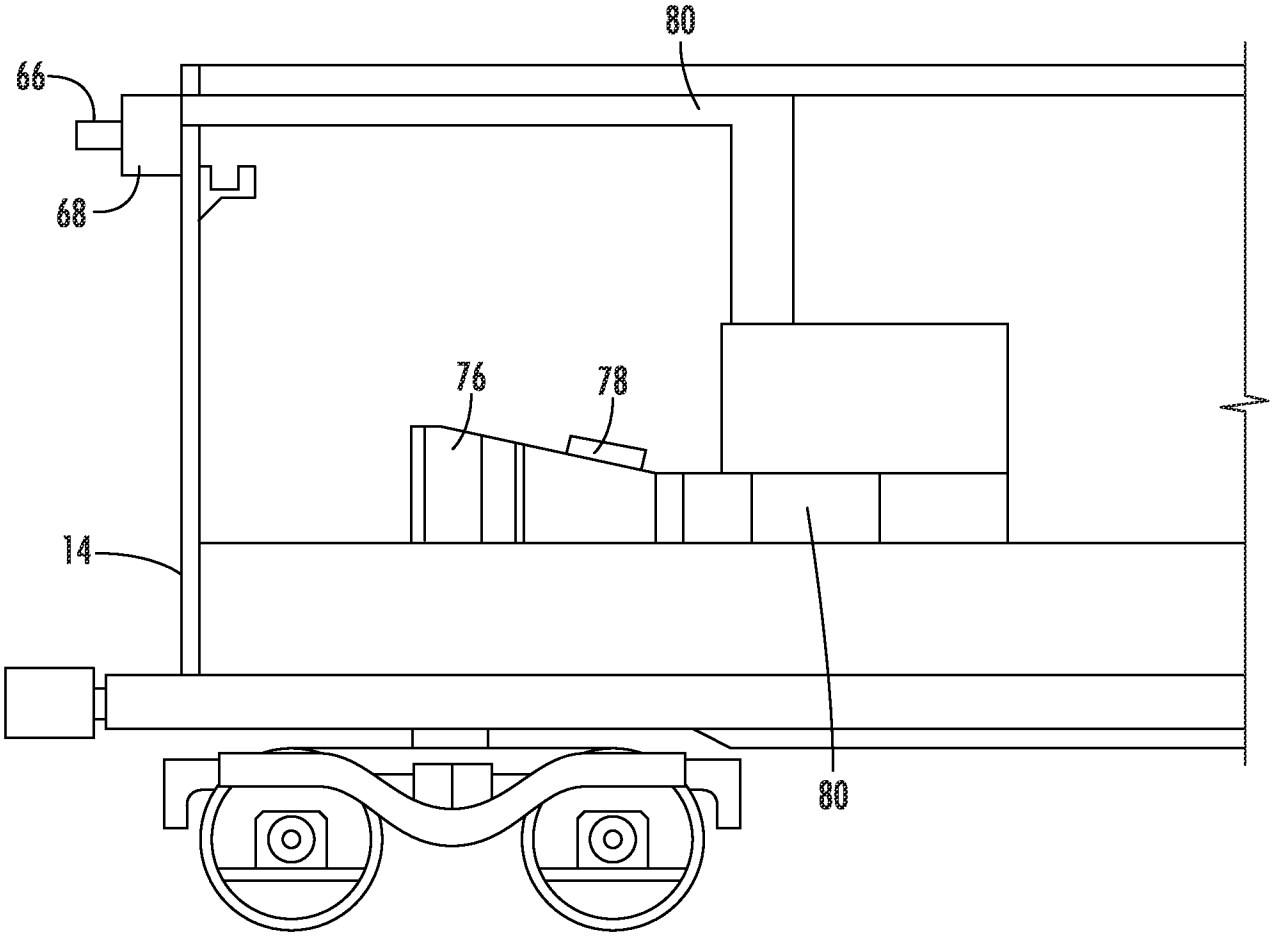
FIG. 24 shows a cross-sectional side view of an air blower and conduits of an autonomous track assessment system according to one embodiment of the present disclosure.

As shown in FIGS. 2 and 23-24, the first sensor assembly 34, the second sensor assembly 36, and the blower 564 are preferably located proximate to each other underneath the rail car 14 to minimize a required length of the plurality of air ducts 566. The first sensor assembly 34 and the second sensor assembly 36 are preferably arranged underneath the rail car 14 such that sensors of the first sensor assembly 34 and the second sensor assembly 36 are oriented to capture data from the railway track 12 at multiple angles.

Referring again to FIG. 1, the autonomous track assessment system 10 further preferably includes a weather station 60 mounted on exterior of the rail car 14 for detecting external environmental conditions around the autonomous track assessment system 10 such as precipitation, temperature, and other environmental conditions. One or more telemetry components 62A and 62B are also preferably mounted on the rail car 14 and may include, for example, cellular or WiFi antennas for communicating data collected on the autonomous track assessment system 10 to a location that is remote from the rail car 14. The one or more telemetry components 62A and 62B are preferably in communication with a telemetry controller 63 (FIG. 2). One or more cameras 64 may be mounted to record the enclosed space of the rail car 14 for security.

The autonomous track assessment system 10 further preferably includes one or more LiDAR sensors 66 located on an exterior of the rail car 14 for capturing data including a corridor through which the rail car 14 is travelling along the railway track 12. The one or more LiDAR sensors 66 are preferably mounted towards an upper portion of a rear side of the boxcar 14 and are preferably mounted in an enclosure 68. A plurality of digital cameras 70 are also located in the enclosure 68. The autonomous track assessment system 10 preferably includes at least two LiDAR sensors 66 mounted on opposing sides of ends of the rail car, as shown in FIG. 22.

Figure 22:
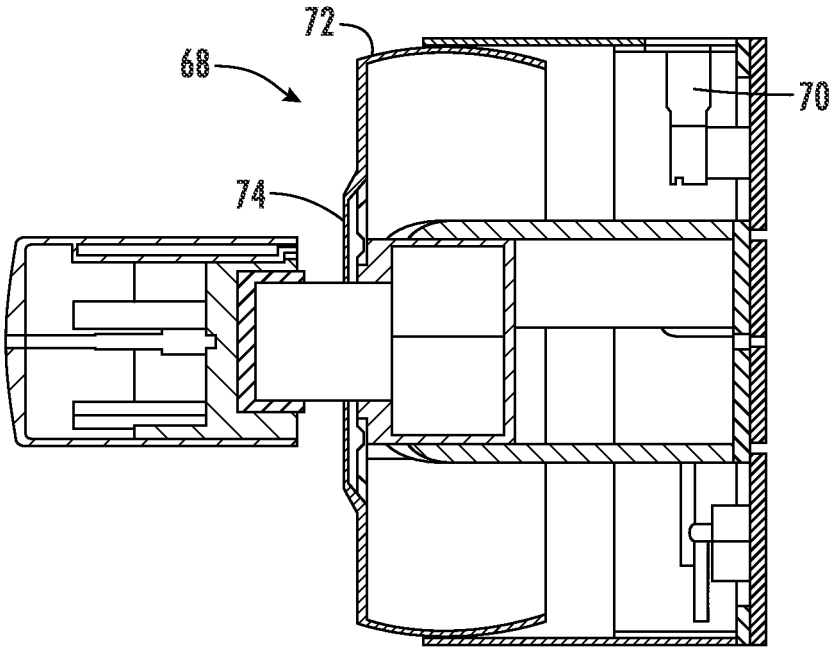
FIG. 22 shows a cross-sectional side view of a LiDAR sensor enclosure according to one embodiment of the present disclosure.

FIG. 22 shows a side cross-sectional view of the sensor enclosure 68 wherein the one or more LiDAR sensors 66 are exposed to collect data. The sensor enclosure 68 includes a sensor enclosure outer cap 72 including a plurality of cap apertures 74 (FIGS. 22 and 23) through which blown air may exit the enclosure 68 to prevent dirt, debris, or precipitation from interfering with the one or more LiDAR sensors 66 as explained in greater detail below. As shown in FIG. 24, a blower 76 is included for blowing air through the enclosure cap 72 and out of the plurality of cap apertures 74. A heater/chiller 78 is provided to heat or cool air from the blower 76 to the one or more LiDAR sensors 66. Air from the blower 76 flows through one or more ducts 80 in the boxcar 14 and through ducts formed through exterior of the boxcar 14, the ducts being in alignment with the sensor enclosure 68 when the sensor enclosure 68 is mounted on the boxcar 14. In one embodiment, air from the blower 76 flows through a computer rack 84 (FIG. 24) located within the rail car 14 for cooling or heating components installed on the computer rack 84. Further, air from the blower 76 may be heated as it passes through the computer rack 84 prior to passing through the enclosure cap 72.

Embodiments further include controlling desirable environmental conditions within the enclosed space of the rail car 14. For example, when various components of controllers including processors and other hardware are located within the rail car 14, conditions such as temperature and humidity may be monitored and a desirable temperature may be maintained using the blower 76 and heater/chiller 78.

Although reference herein is made to the blower 564 shown mounted beneath the rail car 14 proximate to the first sensor assembly 34 and the second sensor assembly 36 and the blower 76 installed within the rail car 14, in one embodiment a single blower may be utilized for heating or cooling the first sensor assembly 34, the second sensor assembly 36, and the one or more LiDAR sensors 66.

The autonomous track assessment system 10 provides for autonomous collection of data from the railway track 12 and a surrounding environment on a platform that is readily compatible with existing railway vehicles. For example, the autonomous track assessment system 10 may be located along an existing train that is transporting freight or other goods without compromising operation of the train. The autonomous track assessment system 10 provides for autonomous collection of data 24 hours per day each day of the year using various sensor assemblies without requiring manual operation or control of the sensor assemblies. Embodiments of the autonomous track assessment system 10 described herein further preferably enable operation of the autonomous track assessment system 10 in harsh environments, such as in extreme cold or heat, without compromising an ability of sensor assemblies of the autonomous track assessment system 10 from capturing data during extreme weather conditions. For example, in extreme cold, it s not uncommon for ice to form on various sensor assemblies. Using the blowers described herein blowing warm air across the outer surfaces of the various sensor assemblies allows the system 10 to keep operating when other systems would be rendered ineffective because of ice build-up or, in the case of extreme hot weather, overheating.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An autonomous railway track assessment apparatus for gathering, storing, and processing profiles of one or both rails on a railway track, the apparatus comprising:

railway track assessment platform including a boxcar including an enclosed space formed therein;

one or more power sources located on the boxcar;

a controller in electrical communication with the one or power sources including at least one processor and a data storage device in communication with the processor;

a first sensor assembly in electronic communication with the controller, the first sensor assembly including a first sensor enclosure, a light emitting device, and one or more first 3D sensors oriented to capture data from the railway track;

a first LiDAR sensor configured to gather data of a rail corridor along a first scan plane and a second LiDAR sensor configured to gather data of a rail corridor along a second scan plane wherein the first LiDAR sensor and the second LiDAR sensor is in electrical communication with the controller and is physically connected to on an outer rear surface of the boxcar;

an air handling system located on the boxcar, the air handling system including an air blower and a heater/chiller;

a set of air ducts in fluid communication with the air handling system, the first sensor assembly, the first LiDAR sensor, and the second LiDAR sensor for supplying heated or cooled blown air from the air from the handling system to the first sensor assembly the first LiDAR sensor, and the second LiDAR sensor;

wherein data from the railway track is autonomously collected by the first sensor assembly, the first LiDAR sensor, and the second LiDAR sensor controlled by the controller and such data is stored on the data storage device.

2. The autonomous railway track assessment apparatus of claim 1 further comprising:

a second sensor assembly in electronic communication with the controller, the second sensor assembly including a second sensor enclosure, a second light emitting device, and one or more second sensors oriented to capture data from the railway track;

the set of air ducts in fluid communication with the air handling system, the first sensor assembly, and the second sensor assembly for supplying heated or cooled blown air from the air handling system to the first sensor assembly and the second sensor assembly;

wherein data from the railway track is autonomously collected by both the first sensor assembly controlled by the controller and the second sensor assembly controlled by the controller and such data is stored on the data storage device.

3. The autonomous railway track assessment apparatus of claim 2 wherein the second sensor assembly is oriented at an oblique angle $\alpha$ relative to the undercarriage of the rail vehicle.

4. The autonomous railway track assessment apparatus of claim 1, wherein the first sensor assembly is oriented at a substantially perpendicular angle relative to the railway track.

5. The autonomous railway track assessment apparatus of claim 1, further comprising a temperature controller in communication with the air handling system wherein the blower and heater/chiller are activated or deactivated by the temperature controller based on environmental conditions of the autonomous railway track assessment apparatus.

6. The autonomous railway track assessment apparatus of claim 5, further comprising one or more valves within ducts between the air handling system and each of the first sensor assembly and the second sensor assembly.

7. An air handling system for an autonomous track assessment apparatus, the air handling system comprising:

a railroad data gathering assembly including a sensor and a light emitter inside a sensor enclosure wherein the railroad data gathering assembly is operable to gather data from a railroad track using the sensor and the light emitter;

an air blower;

a heater/chiller in fluid communication with the air blower;

a temperature controller in electronic communication with the air blower and the heater/chiller;

a temperature sensor in communication with the temperature controller;

at least one sensor assembly comprising a LiDAR sensor mounted on an outer surface of a boxcar;

at least one duct for communicating air from the air blower and heater/chiller to the at least one sensor assembly;

wherein the temperature controller activates and deactivates the air blower and heater/chiller to provide conditioned air to the railroad data gathering assembly based on data received from the temperature sensor wherein the conditioned air is blown out of the sensor enclosure proximate to the sensor and the light emitter to divert debris or precipitation from the sensor and the light emitter.

8. The air handling system for an autonomous track assessment apparatus of claim 7, the LiDAR sensor further including a LiDAR sensor housing having a plurality of apertures formed therethrough for emitting air from the air handling system towards a sensor surface of the LiDAR sensor.

9. The air handling system for an autonomous track assessment apparatus of claim 8, wherein the plurality of apertures are arranged radially around the LiDAR sensor housing.

10. The air handling system for an autonomous track assessment apparatus of claim 8, wherein the LiDAR sensor housing further includes at least one camera located on the LiDAR sensor housing, wherein air flowing through the LiDAR sensor housing towards the plurality of apertures passes proximate to a lens of the at least one camera.

11. The air handling system for an autonomous track assessment apparatus of claim 7, wherein air from the air blower passes through a computer hardware rack prior to passing through the sensor enclosure.

12. An autonomous railway track assessment apparatus for gathering, storing, and processing profiles of one or both rails on a railway track, the apparatus comprising:

railway track assessment platform including a boxcar including an enclosed space formed therein;

one or more power sources located on the boxcar;

a controller in electrical communication with the one or power sources including at least one processor and a data storage device in communication with the processor;

a first sensor assembly in electronic communication with the controller, the first sensor assembly including a first sensor enclosure, a light emitting device, and one or more first sensors oriented to capture data from the railway track wherein the first sensor assembly is oriented at a substantially perpendicular angle relative to the railway track;

a second sensor assembly in electronic communication with the controller, the second sensor assembly including a second sensor enclosure, a light emitting device, and one or more second sensors oriented to capture data from the railway track wherein the second sensor assembly is oriented at an oblique angle relative to the undercarriage of the boxcar;

a first LiDAR sensor inside a first LiDAR sensor housing, the first LiDAR sensor configured to gather data of a rail corridor along a first scan plane wherein the first LiDAR sensor is in electrical communication with the controller and is physically connected to on an outer rear surface of the boxcar;

wherein data is autonomously collected by the first sensor assembly, the second sensor assembly, and the first LiDAR sensor controlled by the controller and such data is stored on the data storage device.

13. The autonomous railway track assessment apparatus of claim 12, further comprising:

an air handling system comprising:

an air blower;

a heater/chiller in fluid communication with the air blower;

a temperature controller in electronic communication with the air blower and the heater/chiller; and a temperature sensor in communication with the temperature controller;

wherein the temperature controller activates and deactivates the air blower and heater/chiller to provide conditioned air to the first sensor assembly, the second sensor assembly, and the first LiDAR sensor based on data received from the temperature sensor wherein the conditioned air is blown out of the sensor enclosure proximate to the sensor and the light emitter to divert debris or precipitation from the sensor and the light emitter.

14. The autonomous railway track assessment apparatus of claim 13 wherein the first LiDAR sensor housing comprises a plurality of apertures formed therethrough for emitting air from the air handling system towards a sensor surface of the first LiDAR sensor.

15. The autonomous railway track assessment apparatus of claim 14 wherein the plurality of apertures are arranged radially around the first LiDAR sensor housing.

16. The autonomous railway track assessment apparatus of claim 14 wherein the first LiDAR sensor housing further includes at least one camera located on the first LiDAR sensor housing, wherein air flowing through the first LiDAR sensor housing towards the plurality of apertures passes proximate to a lens of the at least one camera.

17. The autonomous railway track assessment apparatus of claim 14 wherein air from the air blower passes through a computer hardware rack prior to passing through the sensor enclosure.

18. The autonomous railway track assessment apparatus of claim 12, further comprising a second LiDAR sensor inside a second LiDAR sensor housing, the second LiDAR sensor configured to gather data of a rail corridor along a second scan plane wherein the second LiDAR sensor is in electrical communication with the controller and is physically connected to on an outer rear surface of the boxcar and wherein data is autonomously collected by the second LiDAR sensor controlled by the controller and such data is stored on the data storage device.

* * * * *